US005495555A

United States Patent [19]

Swaminathan

[11] Patent Number: 5,495,555

[45] Date of Patent: Feb. 27, 1996

[54] HIGH QUALITY LOW BIT RATE CELP-BASED SPEECH CODEC

[75] Inventor: Kumar Swaminathan, Gaithersburg, Md.

[73] Assignee: Hughes Aircraft Company, Los Angeles, Calif.

[21] Appl. No.: 905,992

[22] Filed: Jun. 25, 1992

Related U.S. Application Data

[63] Continuation-in-part of Ser. No. 891,596, Jun. 1, 1992.

[51] Int. Cl.[6] ..... G10L 3/02

[52] U.S. Cl. ..... 395/2.16; 395/2.17; 395/2.32; 395/2.28; 395/2.2

[58] Field of Search ..... 395/2, 2.16, 2.17, 395/2.2, 2.23, 2.28, 2.38, 2.39, 2.3–2.32; 381/29, 30, 36, 38, 49

[56] References Cited

U.S. PATENT DOCUMENTS

| | | | |
|---|---|---|---|
| 4,701,955 | 10/1987 | Taguchi | 395/2.32 |
| 4,803,730 | 2/1989 | Thomson | 395/2.16 |
| 4,899,385 | 2/1990 | Ketchum et al. | 395/2.32 |
| 4,924,508 | 5/1990 | Crepy et al. | 395/2.16 |
| 4,989,250 | 1/1991 | Fujimoto et al. | 395/2.16 |
| 5,151,968 | 9/1992 | Tanaka et al. | 395/2.31 |
| 5,195,137 | 3/1993 | Swaminathan | 395/2.31 |
| 5,233,660 | 8/1993 | Chen | 395/2.31 |
| 5,253,269 | 10/1993 | Gerson et al. | 395/2.28 |
| 5,271,089 | 12/1993 | Ozawa | 395/2.31 |
| 5,285,498 | 2/1994 | Johnston | 395/2.31 |
| 5,307,441 | 4/1994 | Tzeng | 395/2.31 |
| 5,327,520 | 7/1994 | Chen | 395/2.31 |

FOREIGN PATENT DOCUMENTS

| | | | |
|---|---|---|---|
| 127729 | 2/1984 | European Pat. Off. | G10L 1/02 |
| 392126 | 4/1989 | European Pat. Off. | G10L 9/14 |
| 454552 | 5/1993 | European Pat. Off. | G10L 9/14 |

OTHER PUBLICATIONS

A High–Quality Multirate Real–Time CELP Coder by Peter Kroon and Kumar Swaminathan, IEEE Journal on Selected Areas in Communications, vol. 10, No. 5, Jun. 1992.

Shihua Wang and Allen Gersho, "Improved Phonetically–Segmented Vector Excitation Coding at 3.4 KB/S," Mar. 23, 1992 IEEE, I–349 to I–352.

*Primary Examiner*—David D. Knepper

*Attorney, Agent, or Firm*—Gordon R. Lindeen, III; Wanda K. Denson-Low

[57] ABSTRACT

Code excited linear prediction (CELP) is performed using two voiced and unvoiced sets of windows, each set is used both for linear prediction and pitch determination. The accompanying degradation in voice quality is comparable to the IS54 standard 8.0 Kbps voice coder employed in U.S. digital cellular systems. This is accomplished by using the same parametric model used in traditional CELP coders but determining, quantizing, encoding, and updating these parameters differently. The low bit rate speech decoder is like most CELP decoders except that it operates in two modes depending on the received mode bit. Both pitch prefiltering and global postfiltering are employed for enhancement of the synthesized speech. In addition, built-in error detection and error recovery schemes are used that help mitigate the effects of any uncorrectable transmission errors.

17 Claims, 15 Drawing Sheets

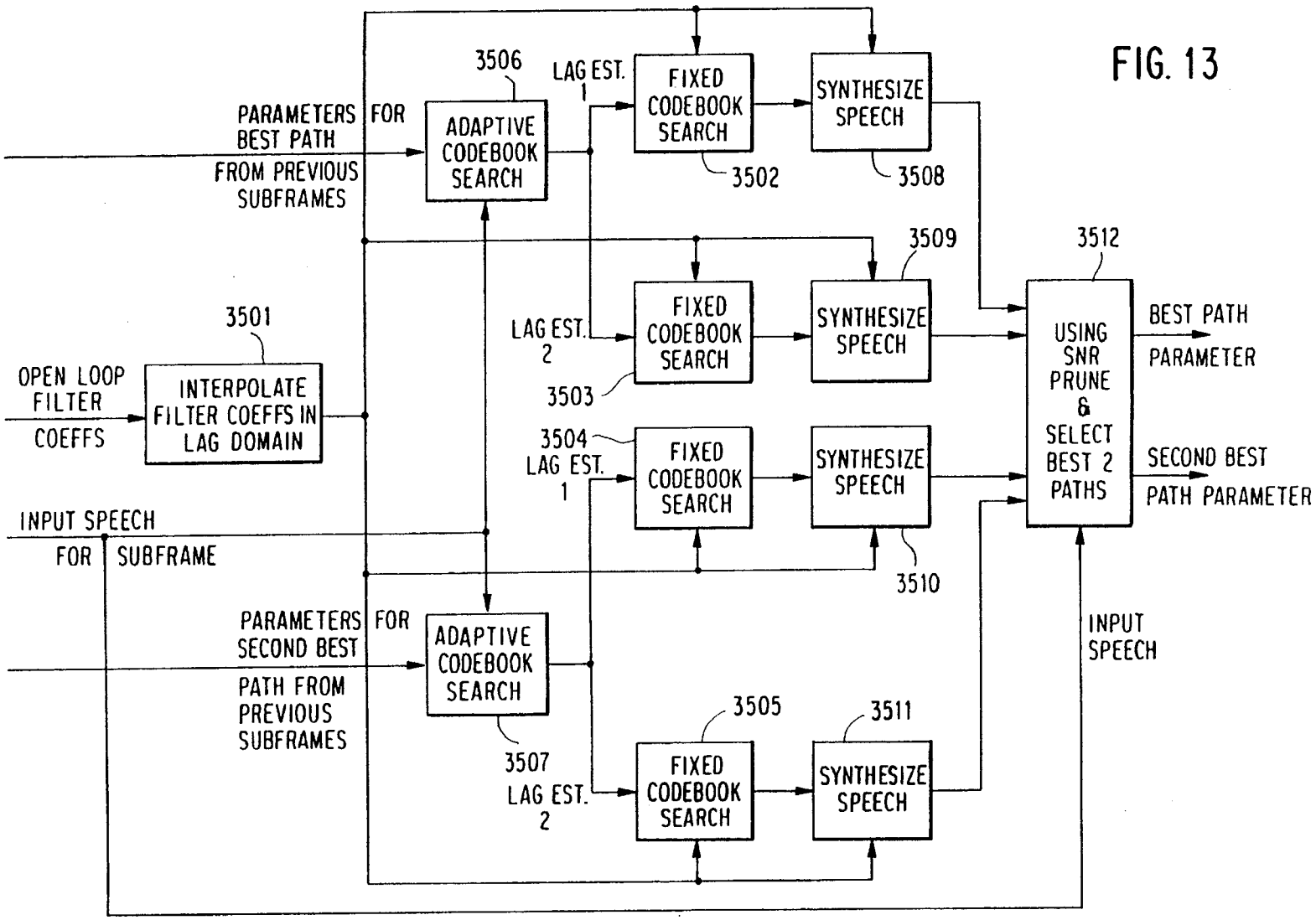
FIG. 13
3512
USING SNR PRUNE & SELECT BEST 2 PATHS
BEST PATH PARAMETER
SECOND BEST PATH PARAMETER
INPUT SPEECH
SYNTHESIZE SPEECH
3508
3509
3510
3511
FIXED CODEBOOK SEARCH
3502
3503
3504
3505
LAG EST. 1
LAG EST. 2
ADAPTIVE CODEBOOK SEARCH
3506
3507
PARAMETERS FOR BEST PATH FROM PREVIOUS SUBFRAMES
PARAMETERS FOR SECOND BEST PATH FROM PREVIOUS SUBFRAMES
INTERPOLATE FILTER COEFFS IN LAG DOMAIN
3501
OPEN LOOP FILTER COEFFS
INPUT SPEECH FOR SUBFRAME NOTES;
OPTIMUM SET OF INDICES/PARAMETERS AFTER DELAYED DECISION: 1-3-2-4-2-1-1; AC: ADAPTIVE CODEBOOK
- - - - : MAPPINGS AFTER PRUNING TO BEST AND SECOND BEST SETS; ——— : OPTIMAL PATH; FC: FIXED CODEBOOK

HIGH QUALITY LOW BIT RATE CELP-BASED SPEECH CODEC

BACKGROUND OF THE INVENTION

The following patent application is a Continuation-in-Part application under 37 CFR 1.62 of pending prior application Ser. No. 07/891,596, filed on Jun. 1, 1992 of Kumar Swaminathan for CELP EXCITATION ANALYSIS FOR VOICED SPEECH.

FIELD OF THE INVENTION

The present invention generally relates to digital voice communications systems and, more particularly, to a low bit rate speech codec that compresses sampled speech data and then decompresses the compressed speech data back to original speech. Such devices are commonly referred to as "codecs" for coder/decoder. The invention has particular application in digital cellular and satellite communication networks but may be advantageously used in any product line that requires speech compression for telecommunications.

DESCRIPTION OF THE PRIOR ART

Cellular telecommunications systems are evolving from their current analog frequency modulated (FM) form towards digital systems. The Telecommunication Industry Association (TIA) has adopted a standard that uses a full rate 8.0 Kbps Vector Sum Excited Linear Prediction (VSELP) speech coder, convolutional coding for error protection, differential quadrature phase shift keying (QPSK) modulations, and a time division, multiple access (TDMA) scheme. This is expected to triple the traffic carrying capacity of the cellular systems. In order to further increase its capacity by a factor of two, the TIA has begun the process of evaluating and subsequently selecting a half rate codec. For the purposes of the TIA technology assessment, the half rate codec along with its error protection should have an overall bit rate of 6.4 Kbps and is restricted to a frame size of 40 ms. The codec is expected to have a voice quality comparable to the full rate standard over a wide variety of conditions. These conditions include various speakers, influence of handsets, background noise conditions, and channel conditions.

An efficient Codebook Excited Linear Prediction (CELP) technique for low rate speech coding is the current U.S. Federal standard 4.8 Kbps CELP coder. While CELP holds the most promise for high voice quality at bit rates in the vicinity of 8.0 Kbps, the voice quality degrades at bit rates approaching 4 Kbps. It is known that the main source of the quality degradation lies in the reproduction of "voiced" speech. The basic technique of the CELP coder consists of searching a codebook of randomly distributed excitation vectors for that vector which produces an output sequence (when filtered through pitch and linear predictive coding (LPC) short-term synthesis filters) that is closest to the input sequence. To accomplish this task, all of the candidate excitation vectors in the codebook must be filtered with both the pitch and LPC synthesis filters to produce a candidate output sequence that can then be compared to the input sequence. This makes CELP a very computationally-intensive algorithm, with typical codebooks consisting of 1024 entries or more. In addition, a perceptual error weighting filter is usually employed, which adds to the computational load. Fast digital signal processors have helped to implement very complex algorithms, such as CELP, in real-time, but the problem of achieving high voice quality at low bit rates persists. In order to incorporate codecs in telecommunications equipment, the voice quality needs to be comparable to the 8.0 Kbps digital cellular standard.

SUMMARY OF THE INVENTION

The present invention provides a technique for high quality low bit-rate speech codec employing improved CELP excitation analysis for voiced speech that can achieve a voice quality that is comparable to that of the full rate codec employed in the North American Digital Cellular Standard and is therefore suitable for use in telecommunication equipment. The invention provides a telecommunications grade codec which increases cellular channel capacity by a factor of two.

In one preferred embodiment of this invention, a low bit rate codec using a voiced speech excitation model compresses any speech data sampled at 8 KHz, e.g., 64 Kbps PCM, to 4.2 Kbps and decompresses it back to the original speech. The accompanying degradation in voice quality is comparable to the IS54 standard 8.0 Kbps voice coder employed in U.S. digital cellular systems. This is accomplished by using the same parametric model used in traditional CELP coders but determining and updating these parameters differently in two distinct modes (A and B) corresponding to stationary voiced speech segments and non-stationary unvoiced speech segments. The low bit rate speech decoder is like most CELP decoders except that it operates in two modes depending on the received mode bit. Both pitch prefiltering and global postfiltering are employed for enhancement of the synthesized speech.

The low bit rate codec according to the above mentioned specific embodiment of the invention employs 40 ms. speech frames. In each speech frame, the half rate speech encoder performs LPC analysis on two 30 ms. speech windows that are spaced apart by 20 ms. The first window is centered at the middle, and the second window is centered at the edge of the 40 ms. speech frame. Two estimates of the pitch are determined using speech windows which, like the LPC analysis windows, are centered at the middle and edge of the 40 ms. speech frame. The pitch estimation algorithm includes both backward and forward pitch tracking for the first pitch analysis window but only backward pitch tracking for the second pitch analysis window.

Based on the two loop pitch estimates and the two sets of quantized filter coefficients, the speech frame is classified into two modes. One mode is predominantly voiced and is characterized by a slowly changing vocal tract shape and a slowly changing vocal chord vibration rate or pitch. This mode is designated as mode A. The other mode is predominantly unvoiced and is designated mode B. In mode A, the second pitch estimate is quantized and transmitted. This is used to guide the closed loop pitch estimation in each subframe. The mode selection criteria employs the two pitch estimates, the quantized filter coefficients for the second LPC analysis window, and the unquantized filter coefficients for the first LPC analysis window.

In one preferred embodiment of this invention, for mode A, the 40 ms. speech frame is divided into seven subframes. The first six are of length 5.75 ms. and the seventh is of length 5.5 ms. In each subframe, the pitch index, the pitch gain index, the fixed codebook index, the fixed codebook gain index, and the fixed codebook gain sign are determined using an analysis by synthesis approach. The closed loop pitch index search range is centered around the quantized pitch estimate derived from the second pitch analysis window of the current 40 ms. frame as well as that of the previous 40 ms. frame if it was a mode A frame or the pitch of the last subframe of the previous 40 ms. frame if it was a mode B frame. The closed loop pitch index search range is a 6-bit search range in each subframe, and it includes both fractional as well as integer pitch delays. The closed loop pitch gain is quantized outside the search loop using three bits in each subframe. The pitch gain quantization tables are different in both modes. The fixed codebook is a 6-bit glottal pulse codebook whose adjacent vectors have all but its end elements in common. A search procedure that exploits this is employed. In one preferred embodiment of this invention, the fixed codebook gain is quantized using four bits in subframes 1, 3, 5, and 7 and using a restricted 3-bit range centered around the previous subframe gain index for subframes 2, 4 and 6. Such a differential gain quantization scheme is not only efficient in terms of bits employed but also reduces the complexity of the fixed codebook search procedure since the gain quantization is done within the search loop. Finally, all of the above parameter estimates are refined using a delayed decision approach. Thus, in every subframe, the closed loop pitch search produces the M best estimates. For each of these M best pitch estimates and N best previous subframe parameters, MN optimum pitch gain indices, fixed codebook indices, fixed codebook gain indices, and fixed codebook gain signs are derived. At the end of the subframe, these MN solutions are pruned to the L best using cumulative signal-to-noise ratio (SNR) as the criteria. For the first subframe, M= 2, N=1, L=2 are used. For the last subframe, M=2, N=2, L=1 are used, while for the other subframes, M=2, N=2, L=2 are used. The delayed decision approach is particularly effective in the transition of voiced to unvoiced and unvoiced to voiced regions. Furthermore, it results in a smoother pitch trajectory in the voiced region. This delayed decision approach results in N times the complexity of the closed loop pitch search but much less than MN times the complexity of the fixed codebook search in each subframe. This is because only the correlation terms need to be calculated MN times for the fixed codebook in each subframe but the energy terms need to be calculated only once.

For mode B, the 40 ms. speech frame is divided into five subframes, each having a length of 8 ms. In each subframe, the pitch index, the pitch gain index, the fixed codebook index, and the fixed codebook gain index are determined using a closed loop analysis by synthesis approach. The closed loop pitch index search range spans the entire range of 20 to 146. Only integer pitch delays are used. The open loop pitch estimates are ignored and not used in this mode. The closed loop pitch gain is quantized outside the search loop using three bits in each subframe. The pitch gain quantization tables are different in the two modes. The fixed codebook is a 9-bit multi-innovation codebook consisting of two sections. One is a Hadamard vector sum section and the other is a zinc pulse section. This codebook employs a search procedure that exploits the structure of these sections and guarantees a positive gain. The fixed codebook gain is quantized using four bits in all subframes outside of the search loop. As pointed out earlier, the gain is guaranteed to be positive and therefore no sign bit needs to be transmitted with each fixed codebook gain index. Finally, all of the above parameter estimates are refined using a delayed decision approach identical to that employed in mode A.

BRIEF DESCRIPTION OF THE DRAWINGS

The foregoing and other objects, aspects and advantages will be better understood from the following detailed description of a preferred embodiment of the invention with reference to the drawings, in which:

FIG. 13 is a block diagram showing in more detail the implementation of the excitation modeling circuitry of the encoder shown in FIG. 3;

DETAILED DESCRIPTION OF A PREFERRED EMBODIMENT OF THE INVENTION

Figure 1:
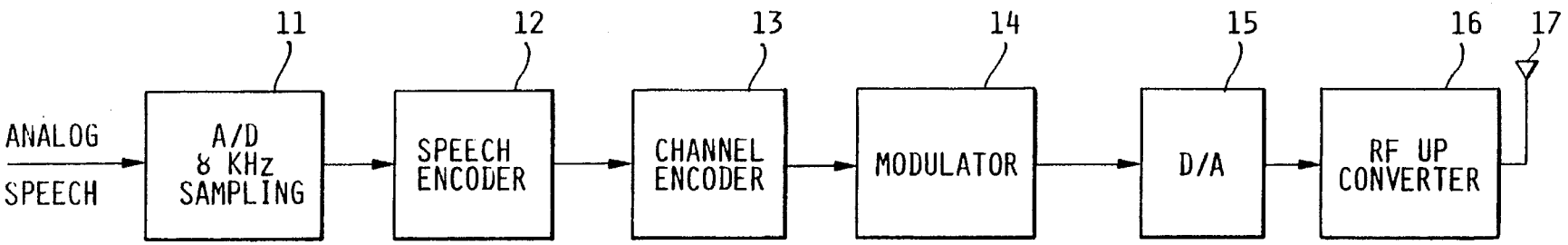
FIG. 1 is a block diagram of a transmitter in a wireless communication system that employs low bit rate speech coding according to the invention.

Referring now to the drawings, and more particularly to FIG. 1, there is shown in block diagram form a transmitter in a wireless communication system that employs the low bit rate speech coding according to the invention. Analog speech, from a suitable handset, is sampled at an 8 KHz rate and converted to digital values by analog-to-digital (A/D) converter 11 and supplied to the speech encoder 12, which is the subject of this invention. The encoded speech is further encoded by channel encoder 13, as may be required, for example, in a digital cellular communications system, and the resulting encoded bit stream is supplied to a modulator 14. Typically, phase shift keying (PSK) is used and, therefore, the output of the modulator 14 is converted by a digital-to-analog (D/A) converter 15 to the PSK signals that are amplified and frequency multiplied by radio frequency (RF) up convertor 16 and radiated by antenna 17.

The analog speech signal input to the system is assumed to be low pass filtered using an antialiasing filter and sampled at 8 Khz. The digitized samples from A/D converter 11 are high pass filtered prior to any processing using a second order biquad filter with transfer function $$H_{HP}(Z)=\frac{1-2Z^{-1}+Z^{-2}}{1-1.8891Z^{-1}+0.89503Z^{-2}}.$$

The high pass filter is used to attenuate any d.c. or hum contamination in the incoming speech signal.

Figure 2:
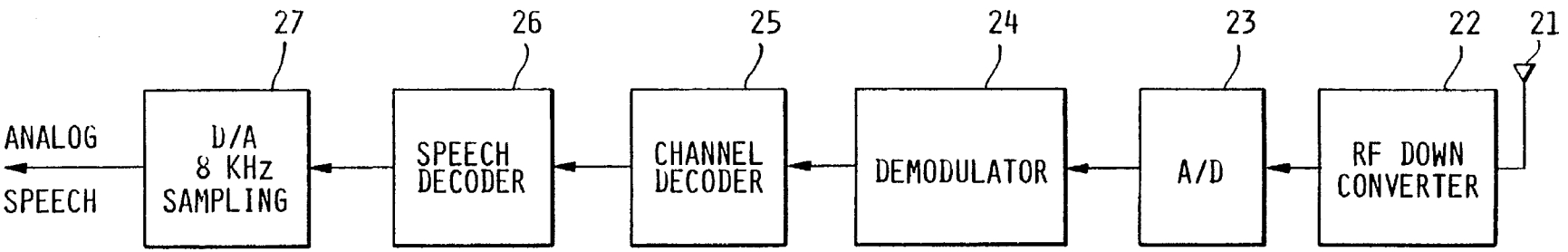
FIG. 2 is a block diagram of a receiver in a wireless communication system that employs low bit rate speech coding according to the invention.

In FIG. 2, the transmitted signal is received by antenna 21 and heterodyned to an intermediate frequency (IF) by RF down converter 22. The IF signal is converted to a digital bit stream by A/D converter 23, and the resulting bit stream is demodulated in demodulator 24. At this point the reverse of the encoding process in the transmitter takes place. Specifically, decoding is performed by channel decoder 25 and the speech decoder 26, the latter of which is also the subject of this invention. Finally, the output of the speech decoder is supplied to the D/A converter 27 having an 8 KHz sampling rate to synthesize analog speech.

Figure 3:
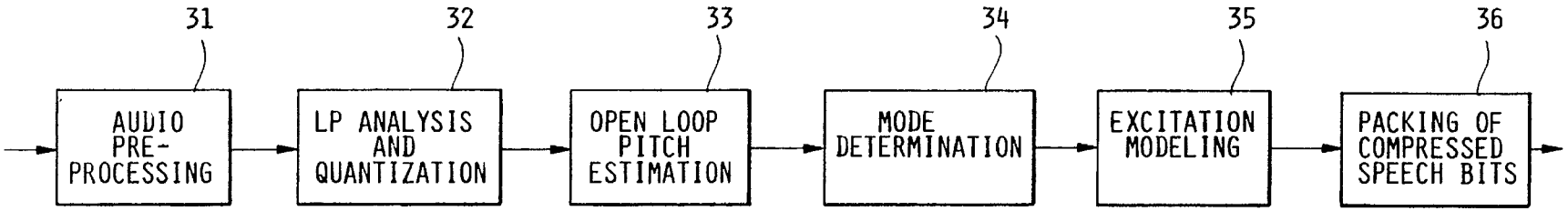
FIG. 3 is block diagram of the encoder used in the transmitter shown in FIG. 1.

The encoder 12 of FIG. 1 is shown in FIG. 3 and includes an audio preprocessor 31 followed by linear predictive (LP) analysis and quantization in block 32. Based on the output of block 32, pitch estimation is made in block 33 and a determination of mode, either mode A or mode B as described in more detail hereinafter, is made in block 34. The mode, as determined in block 34, determines the excitation modeling in block 35, and this is followed by packing of compressed speech bits by a processor 36.

Figure 4:
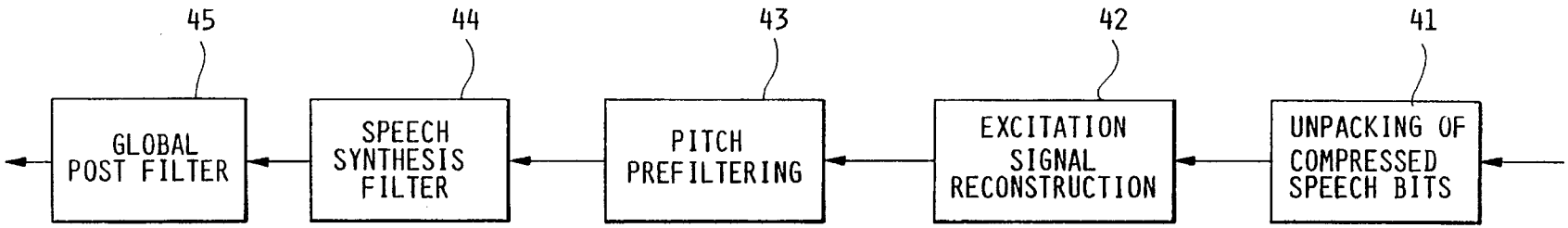
FIG. 4 is a block diagram of the decoder used in the receiver shown in FIG. 2.

The decoder 26 of FIG. 2 is shown in FIG. 4 and includes a processor 41 for unpacking of compressed speech bits. The unpacked speech bits are used in block 42 for excitation signal reconstruction, followed by pitch prefiltering in filter 43. The output of filter 43 is further filtered in speech synthesis filter 44 and global post filter 45.

Figure 5A:
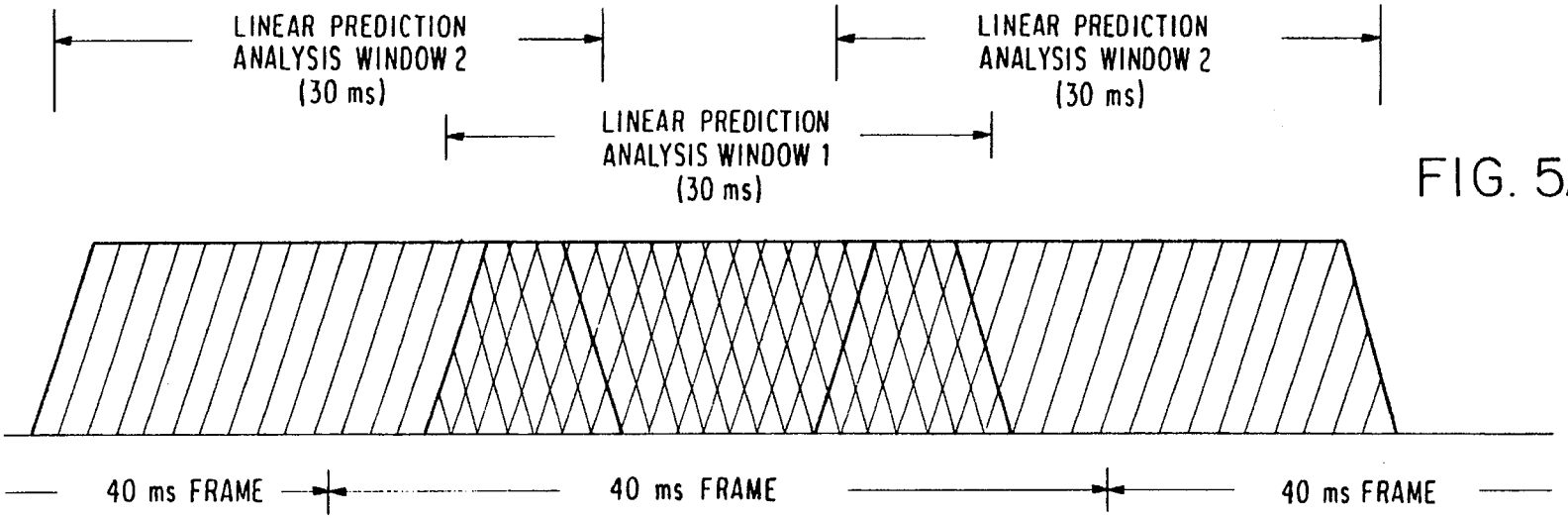
FIG. 5A is a timing diagram showing the alignment of linear prediction analysis windows in the practice of the invention.

The low bit rate codec of FIG. 3 employs 40 ms. speech frames. In each speech frame, the low bit rate speech encoder performs LP (linear prediction) analysis in block 32 on two 30 ms. speech windows that are spaced apart by 20 ms. The first window is centered at the middle and the second window is centered at the end of the 40 ms. speech frame. The alignment of both the LP analysis windows is shown in FIG. 5A. Each LP analysis window is multiplied by a Hamming window and followed by a tenth order autocorrelation method of LP analysis. Both sets of filter coefficients are bandwidth broadened by 15 Hz and converted to line spectral frequencies. These ten line spectral frequencies are quantized by a 26-bit LSF VQ in this embodiment. This 26-bit LSF VQ is described next.

Figure 6A:
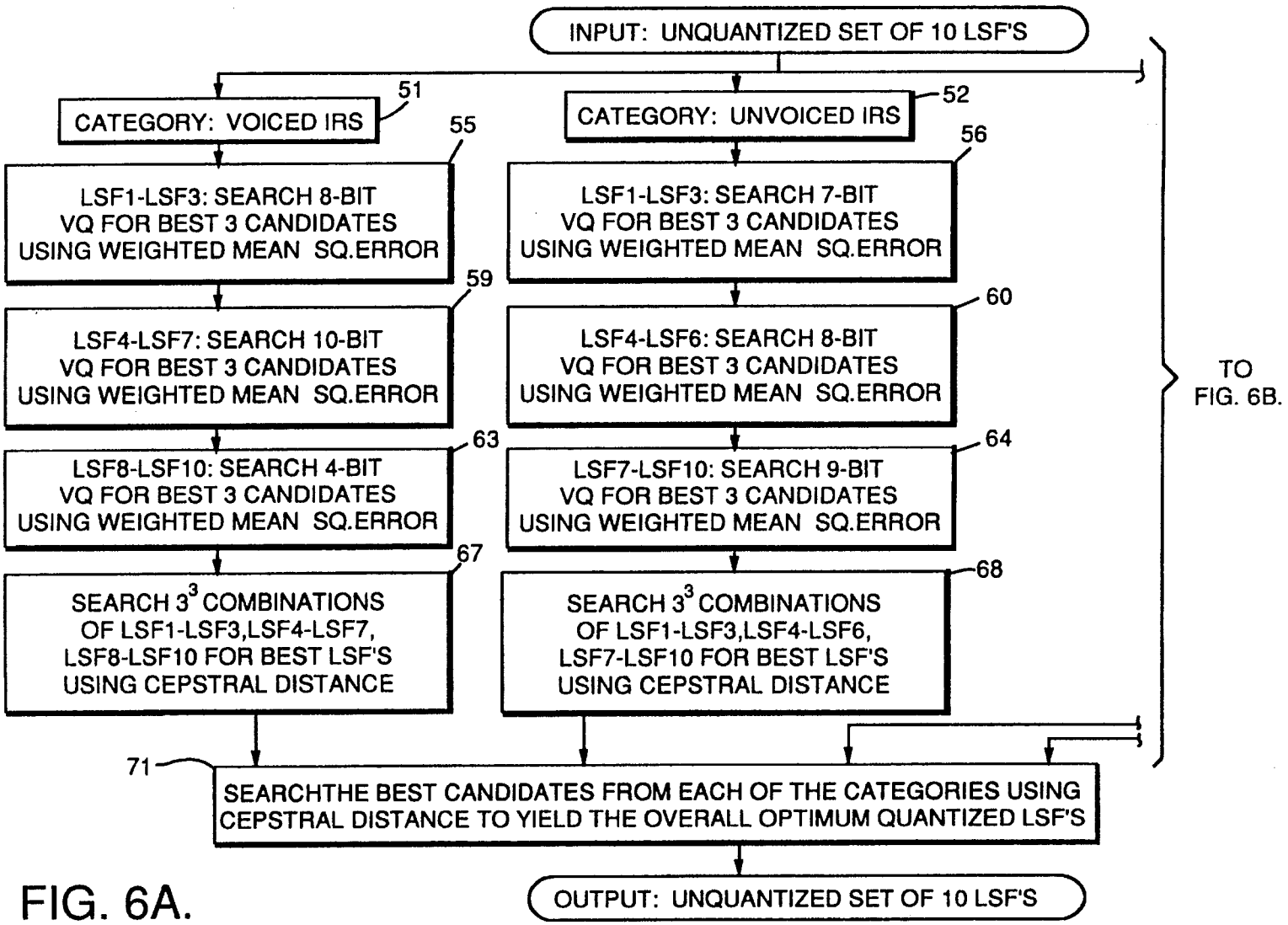
FIG. 6 is a flowchart illustrating the 26-bit line spectral frequency vector quantization process of the invention.
Figure 6B:
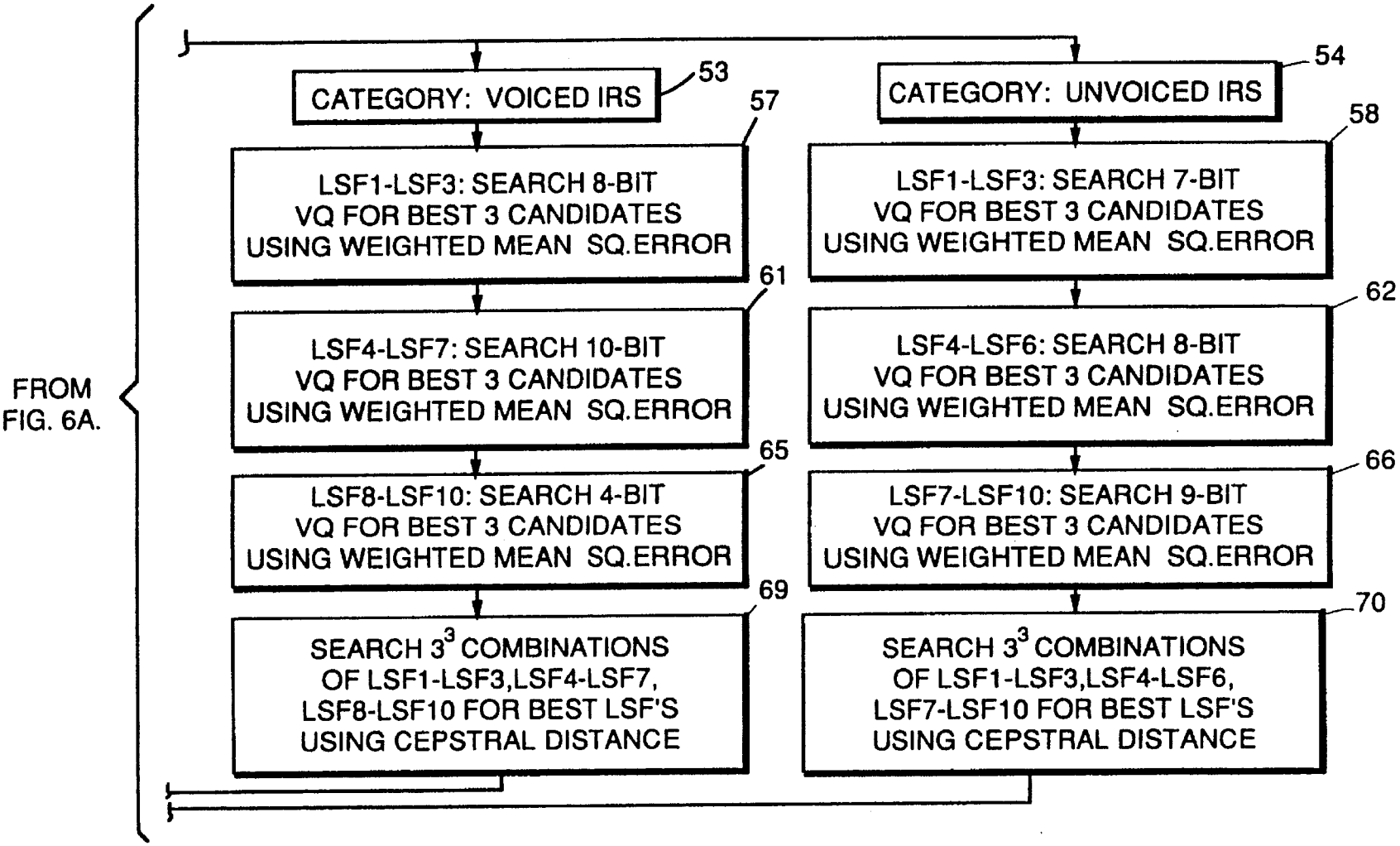

The ten line spectral frequencies for both sets are quantized in block 32 by a 26-bit multi-codebook split vector quantizer. This 26-bit LSF vector quantizer classifies the unquantized line spectral frequency vector as a "voice IRS-filtered", "unvoiced IRS-filtered", "voiced non-IRS-filtered", and "unvoiced non-IRS-filtered" vector, where "IRS" refers to intermediate reference system filter as specified by CCITT, Blue Book, Rec. P.48. An outline of the LSF vector quantization process is shown in FIG. 6 in the form of a flowchart. For each classification, a split vector quantizer is employed. For the "voiced IRS-filtered" and the "voiced non-IRS-filtered" categories 51 and 53, a 3-4-3 split vector quantizer is used. The first three LSFs use an 8-bit codebook in function blocks 55 and 57, the next four LSFs use a 10-bit codebook in function blocks 59 and 61, and the last three LSFs use a 6-bit codebook in function blocks 63 and 65. For the "unvoiced IRS-filtered" and the "unvoiced non-IRS-filtered" categories 52 and 54, a 3-3-4 split vector quantizer is used. The first three LSFs use a 7-bit codebook in function blocks 56 and 58, the next three LSFs use an 8-bit vector codebook in function blocks 60 and 62, and the last four LSFs use a 9-bit codebook in function blocks 64 and 66. From each split vector codebook, the three best candidates are selected in function blocks 67, 68, 69, and 70 using the energy weighted mean square error criteria. The energy weighting reflects the power level of the spectral envelope at each line spectral frequency. The three best candidates for each of the three split vectors results in a total of twenty-seven combinations for each category. The search is constrained so that at least one combination would result in an ordered set of LSFs. This is usually a very mild constraint imposed on the search. The optimum combination of these twenty-seven combinations is selected in function block 71 based on the cepstral distortion measure. Finally, the optimal category or classification is determined also on the basis of the cepstral distortion measure. The quantized LSFs are converted to filter coefficients and then to autocorrelation lags for interpolation purposes.

The resulting LSF vector quantizer scheme is not only effective across speakers but also across varying degrees of IRS filtering which models the influence of the handset transducer. The codebooks of the vector quantizers are trained from a sixty talker speech database using flat as well as IRS frequency shaping. This is designed to provide consistent and good performance across several speakers and across various handsets. The average log spectral distortion across the entire TIA half rate database is approximately 1.2 dB for IRS filtered speech data and approximately 1.3 dB for non-IRS filtered speech data.

Figure 5B:
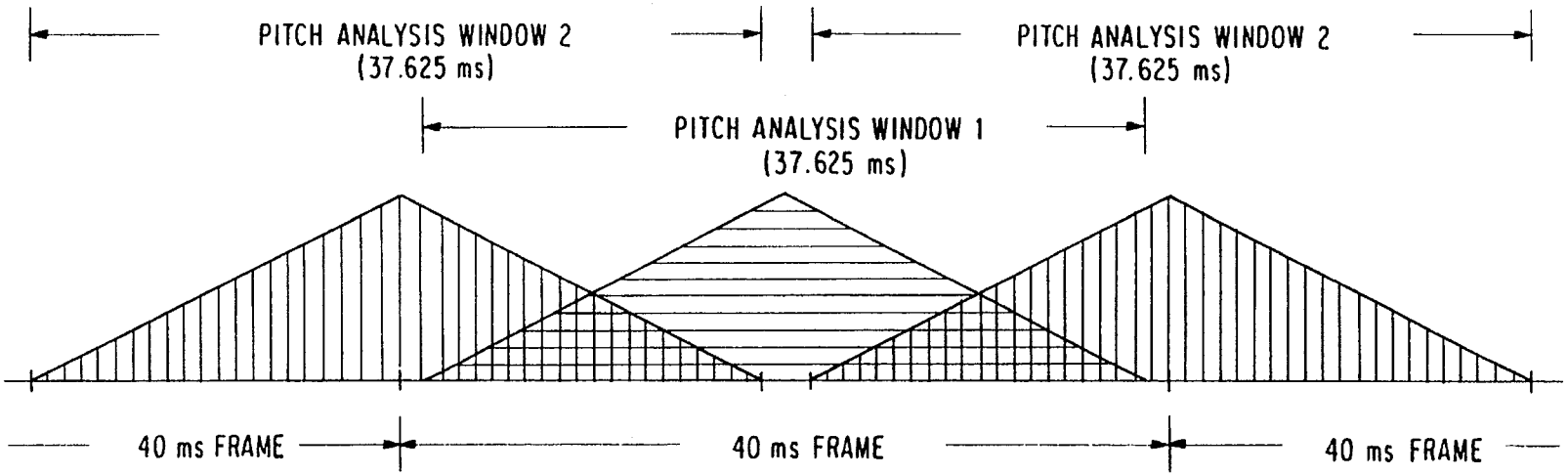
FIG. 5B is a timing diagram showing the alignment of pitch prediction analysis windows for open loop pitch prediction in the practice of the invention.

Two pitch estimates are determined from two pitch analysis windows that, like the linear prediction analysis windows, are spaced apart by 20 ms. The first pitch analysis window is centered at the end of the 40 ms. frame. Each pitch analysis window is 301 samples or 37.625 ms. long. The pitch analysis window alignment is shown in FIG. 5B.

Figure 7:
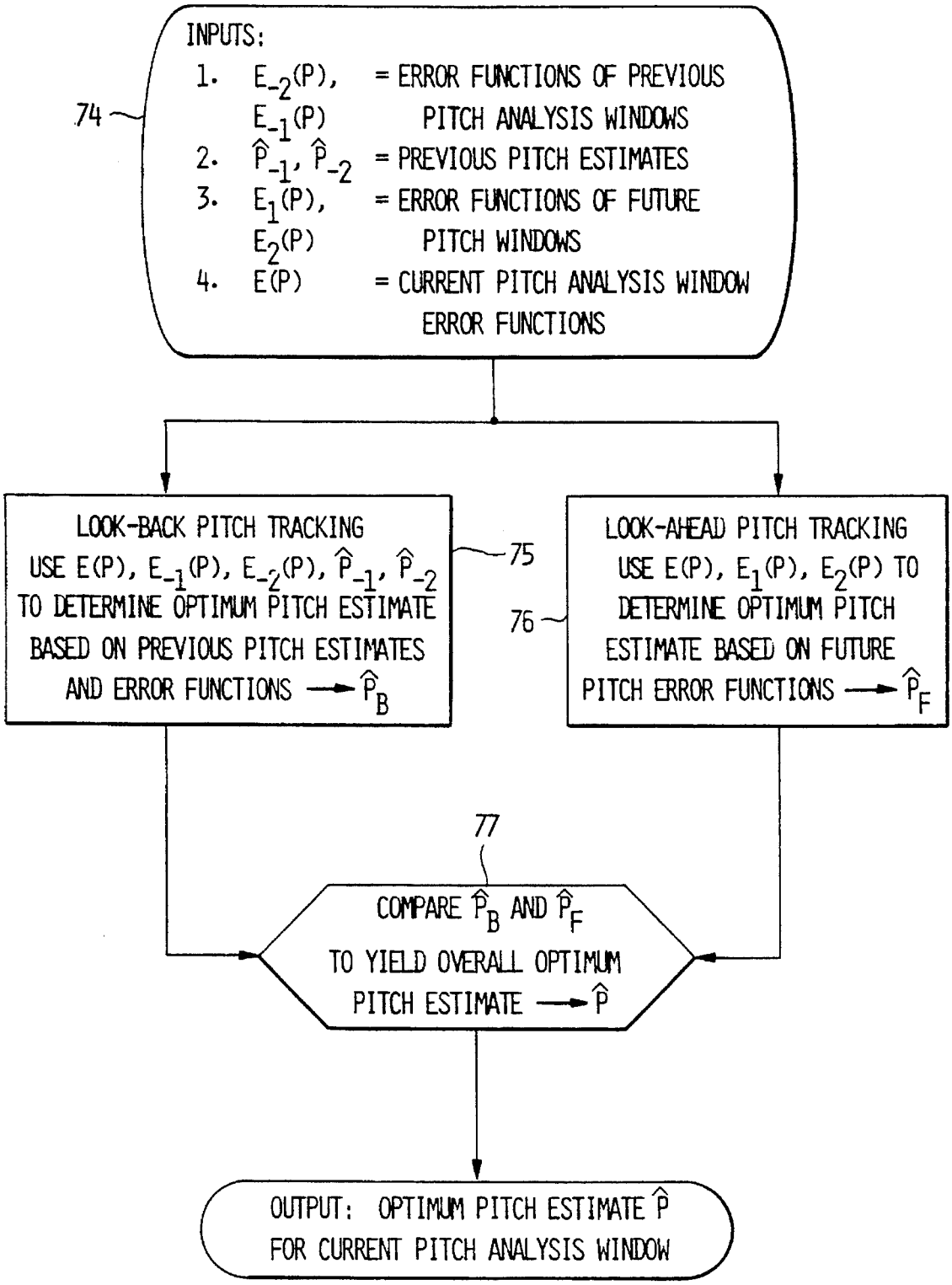
FIG. 7 PRIOR ART
FIG. 7 is a flowchart illustrating the operation of a known pitch tracking algorithm.

The pitch estimates in block 33 in FIG. 3 are derived from the pitch analysis windows using a modified form of a known pitch estimation algorithm. A flowchart of a known pitch tracking algorithm is shown in FIG. 7. This pitch estimation algorithm makes an initial pitch estimate in function block 73 using an error function which is calculated for all values in the set {22.0, 22.5, . . . , 114.5}. This is followed by pitch tracking to yield an overall optimum pitch value. Look-back pitch tracking in function block 74 is employed using the error functions and pitch estimates of the previous two pitch analysis windows. Look-ahead pitch tracking in function block 75 is employed using the error functions of the two future pitch analysis windows. Pitch estimates based on look-back and look-ahead pitch tracking are compared in decision block 76 to yield an overall optimum pitch value at output 77. The known pitch estimation algorithm requires the error functions of two future pitch analysis windows for its look-ahead pitch tracking and thus introduces a delay of 40 ms. In order to avoid this penalty, the pitch estimation algorithm is modified by the invention.

Figure 8:
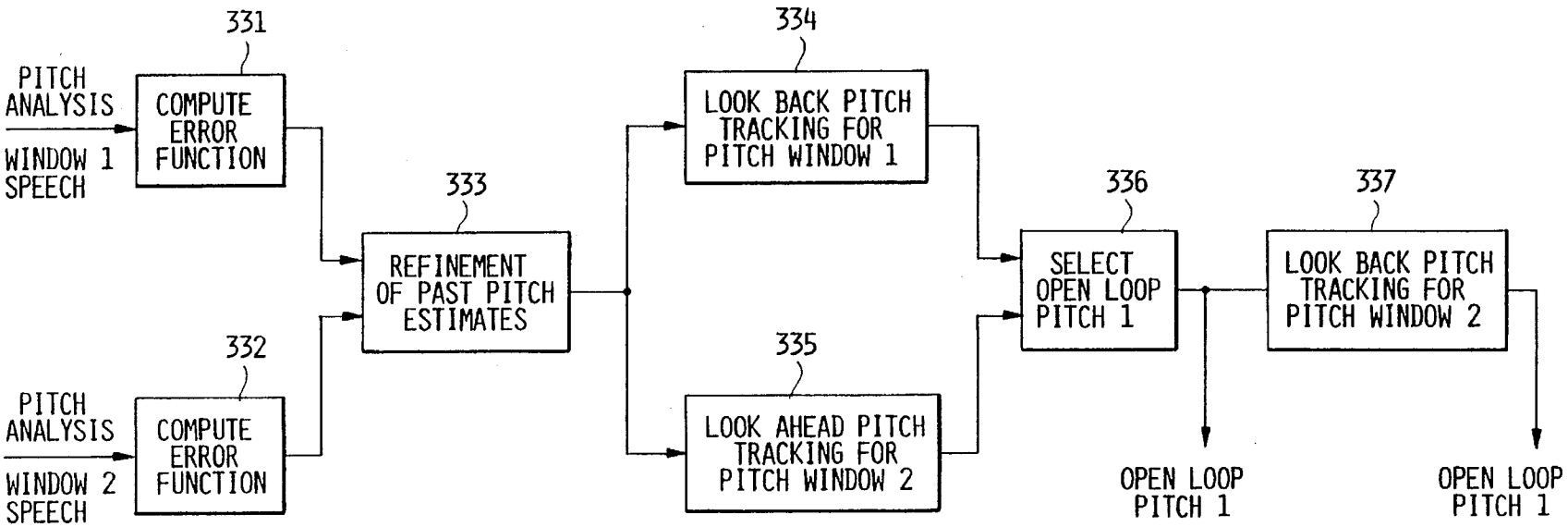
FIG. 8 is a block diagram showing in more detail the implementation of the open loop pitch estimation of the encoder shown in FIG. 3.

FIG. 8 shows a specific implementation of the open loop pitch estimation 33 of FIG. 3. Pitch analysis speech windows one and two are input to respective compute error functions 331 and 332. The outputs of these error function computations are input to a refinement of past pitch estimates 333, and the refined pitch estimates are sent to both look back and look ahead pitch tracking 334 and 335 for pitch window one. The outputs of the pitch tracking circuits are input to selector 336 which selects the open loop pitch one as the first output. The selected open loop pitch one is also input to a look back pitch tracking circuit for pitch window two which outputs the open loop pitch two.

Figure 9:
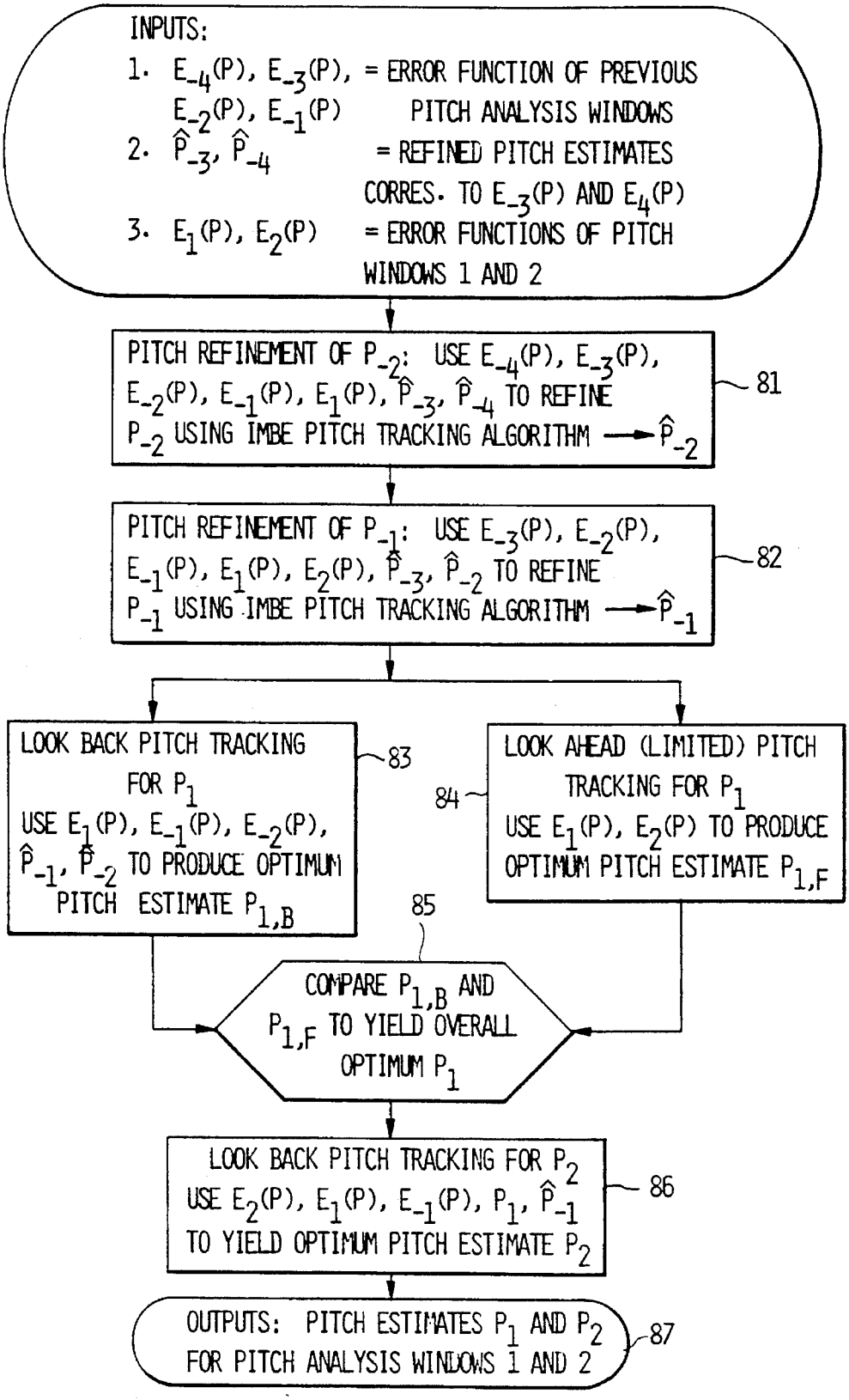
FIG. 9 is a flowchart illustrating the operation of the modified pitch tracking algorithm implemented by the open loop pitch estimation shown in FIG. 8.

The modified pitch tracking algorithm implemented by the pitch estimation circuitry of FIG. 8 is shown in the flowchart of FIG. 9. The modified pitch estimation algorithm employs the same error function as in the known pitch estimation algorithm in each pitch analysis window, but the pitch tracking scheme is altered. Prior to pitch tracking for either the first or second pitch analysis window, the previous two pitch estimates of the two previous pitch analysis windows are refined in function blocks 81 and 82, respectively, with both look-back pitch tracking and look-ahead pitch tracking using the error functions of the current two pitch analysis windows. This is followed by look-back pitch tracking in function block 83 for the first pitch analysis window using the refined pitch estimates and error functions of the two previous pitch analysis windows. Look-ahead pitch tracking for the first pitch analysis window in function block 84 is limited to using the error function of the second pitch analysis window. The two estimates are compared in decision block 85 to yield an overall best pitch estimate for the first pitch analysis window. For the second pitch analysis window, look-back pitch tracking is carried out in function block 86 as well as the pitch estimate of the first pitch analysis window and its error function. No look-ahead pitch tracking is used for this second pitch analysis window with the result that the look-back pitch estimate is taken to be the overall best pitch estimate at output 87.

Every 40 ms. speech frame is classified into two modes in block 34 of FIG. 3. One mode is predominantly voiced and is characterized by a slowly changing vocal tract shape and a slowly changing vocal chord vibration rate or pitch. This mode is designated as mode A. The other mode is predominantly unvoiced and is designated as mode B. The mode selection is based on the inputs listed below:

1. The set of filter coefficients for the first linear prediction analysis window. The filter coefficients are denoted by $\{a_1(i)\}$ for $0 \leqq i \leqq 10$ with $a_1(0)=1.0$. In vector notation, this is denoted as $a_1$.
2. Interpolated set of filter coefficients for the first linear prediction analysis window. This interpolated set is obtained by interpolating the quantized filter coefficients for the second linear prediction analysis window for the current 40 ms. frame and the previous 40 ms. frame in the autocorrelation domain. These filter coefficients are denoted by $\{\bar{a}_1(i)\}$ for $0 \leqq i \leqq 10$ with $\bar{a}_1(0)=1.0$. In vector notation, this is denoted as $\bar{a}_1$.
3. Refined pitch estimate of previous second pitch analysis window denoted by $\hat{P}_{-1}$.
4. Pitch estimate for first pitch analysis window denoted by $P_1$.
5. Pitch estimate for second pitch analysis window denoted by $P_2$.

Figure 10:
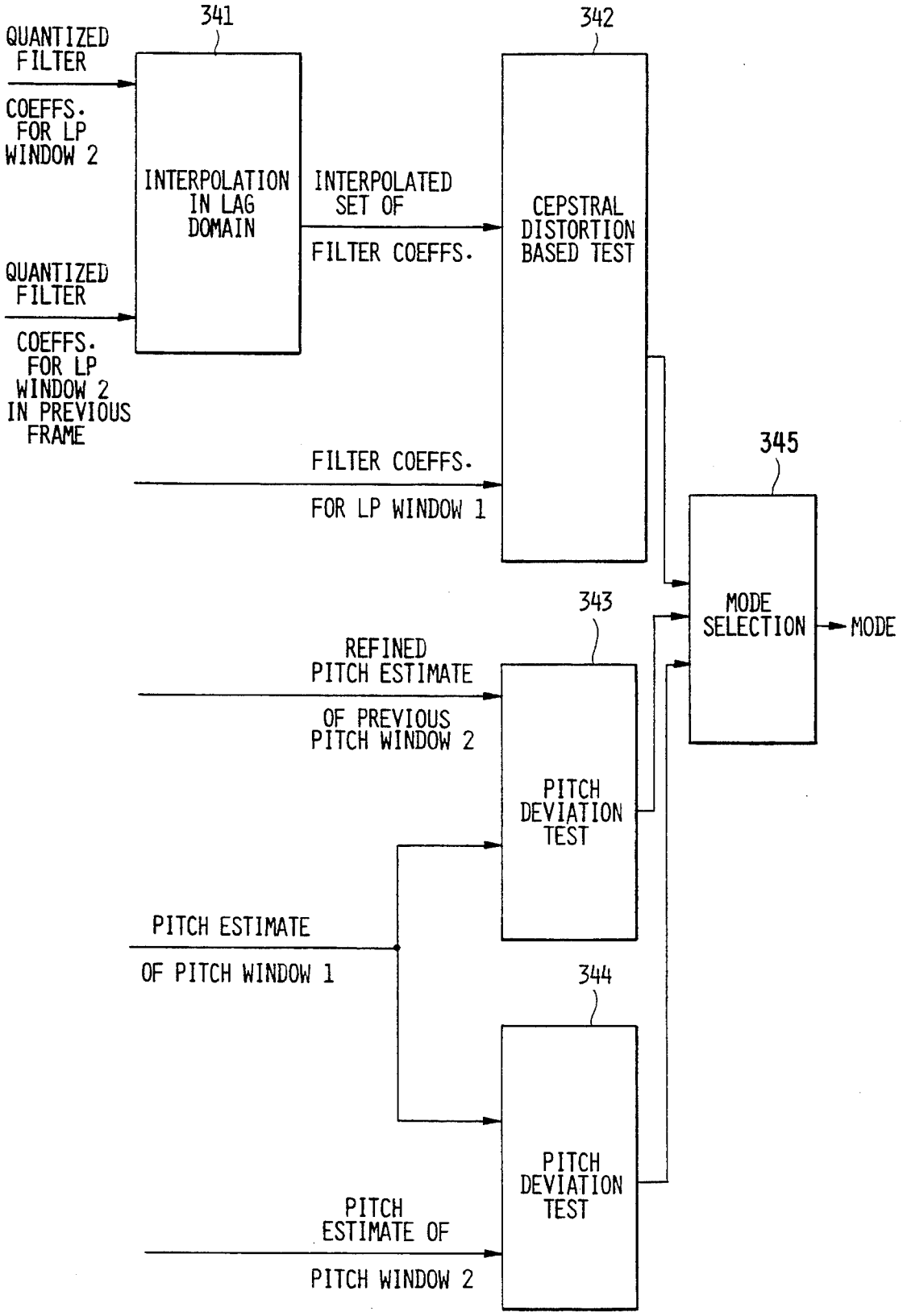
FIG. 10 is a block diagram showing in more detail the implementation of the mode determination of the encoder shown in FIG. 3.

Using the first two inputs, the cepstral distortion measure $d_c(a_1,\bar{a}_1)$ between the filter coefficients $\{a_1\ (i)\}$ and the interpolated filter coefficients $\{\bar{a}_1(i)\}$ is calculated and expressed in dB (decibels). The block diagram of the mode selection 34 of FIG. 3 is shown in FIG. 10. The quantized filter coefficients for linear predicative window two and for linear predictive window two of the previous frame are input to interpolator 341 which interpolates the coefficients in the autocorrelation domain. The interpolated set of filter coefficients are input to the first of three test circuits. This test circuit 342 makes a cepstral distortion based test of the interpolated set of filter coefficients for window two against the filter coefficients for window one. The second test circuit 343 makes a pitch deviation test of the refined pitch estimate of the previous pitch window two against the pitch estimate of pitch window one. The third test circuit 344 makes a pitch deviation test of the pitch estimate of pitch window two against the pitch estimate of pitch window one. The outputs of these test circuits are input to mode selector 345 which selects the mode.

Figure 11:
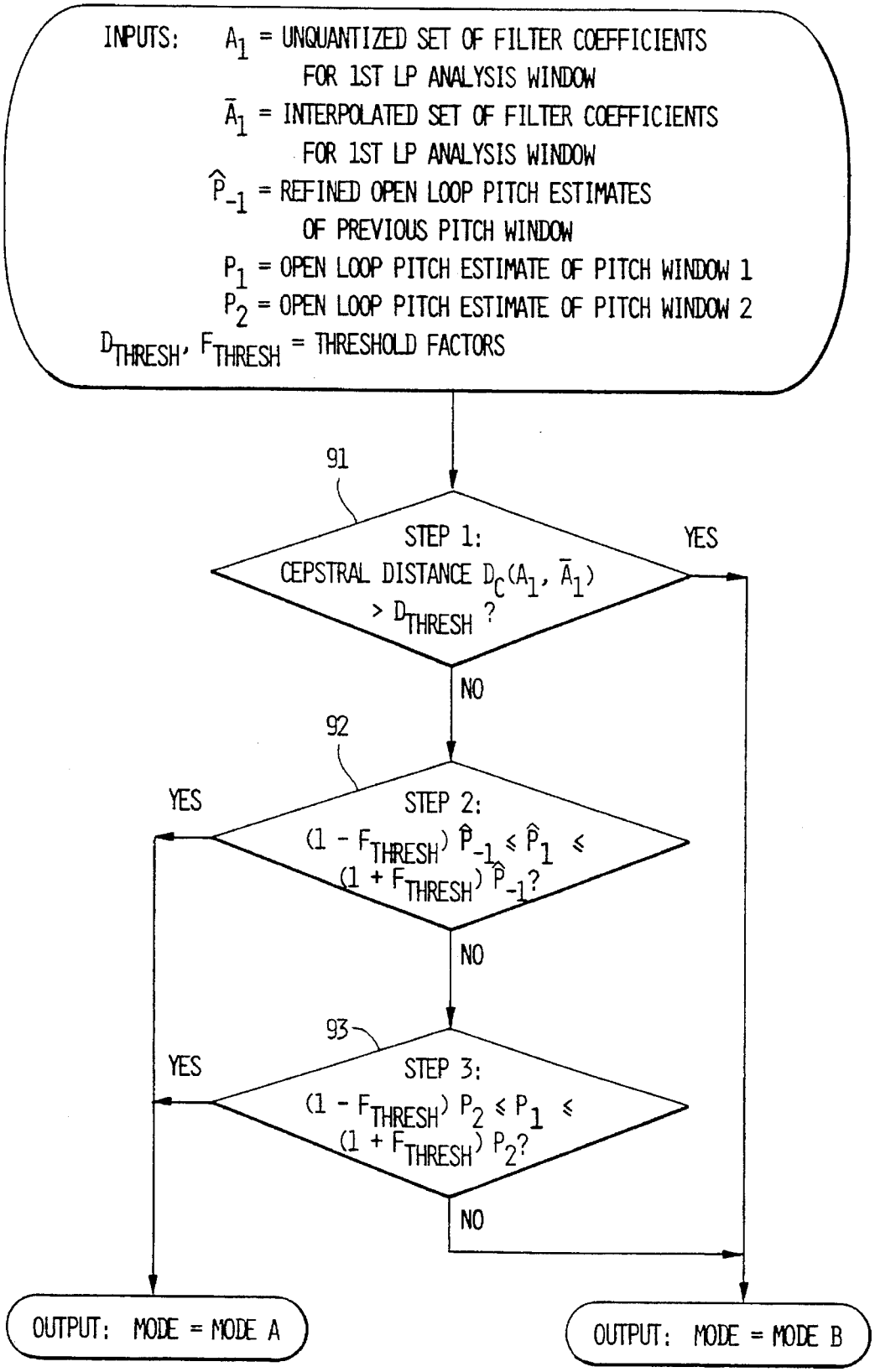
FIG. 11 is a flowchart illustrating the mode selection procedure implemented by the mode determination circuitry shown in FIG. 10.

As shown in the flowchart of FIG. 11, the mode selection implemented by the mode determination circuitry of FIG. 10 is a three step process. The first step in decision block 91 is made on the basis of the cepstral distortion measure which is compared to a given absolute threshold. If the threshold is exceeded, the mode is declared as mode B. Thus, $$STEP\ 1{:}IF(d_c(a_1,\bar{a}_1)>d_{thresh})Mode{=}Mode\ B.$$

Here, $d_{thresh}$ is a threshold that is a function of the mode of the previous 40 ms. frame. If the previous mode were mode A, $d_{thresh}$ takes on the value of −6.25 dB. If the previous mode were mode B, $d_{thresh}$ takes on the value of −6.75 dB. The second step in decision block 92 is undertaken only if the test in the first step fails, i.e., $d_c(a_1,\bar{a}_1) \leqq d_{thresh}$. In this step, the pitch estimate for the first pitch analysis window is compared to the refined pitch estimate of the previous pitch analysis window. If they are sufficiently close, the mode is declared as mode A. Thus, $$STEP\ 2{:}IF(1-f_{thresh})P_2 \leqq P_1 \leqq (1+f_{thresh})P_2)Mode{=}Mode\ A.$$

Here, $f_{thresh}$ is a threshold factor that is a function of the previous mode. If the mode of the previous 40 ms. frame were mode A, the $f_{thresh}$ takes on the value of 0.15. Otherwise, it has a value of 0.10. The third step in decision block 93 is undertaken only if the test in the second step fails. In this third step, the open Iccp pitch estimate for the first pitch analysis window is compared to the open Iccp pitch estimate of the second pitch analysis window. If they are sufficiently close, the mode is declared as mode A. Thus, $$STEP\ 3{:}IF((1-f_{thresh})P_2 \leqq P_1 \leqq (1+f_{thresh})P_2)Mode{=}Mode\ A.$$

The same threshold factor $f_{thresh}$ is used in both steps 2 and 3. Finally, if the test in step 3 were to fail, the mode is declared as mode B. At the end of the mode selection process, the thresholds $d_{thresh}$ and $f_{thresh}$ are updated.

Figure 12:
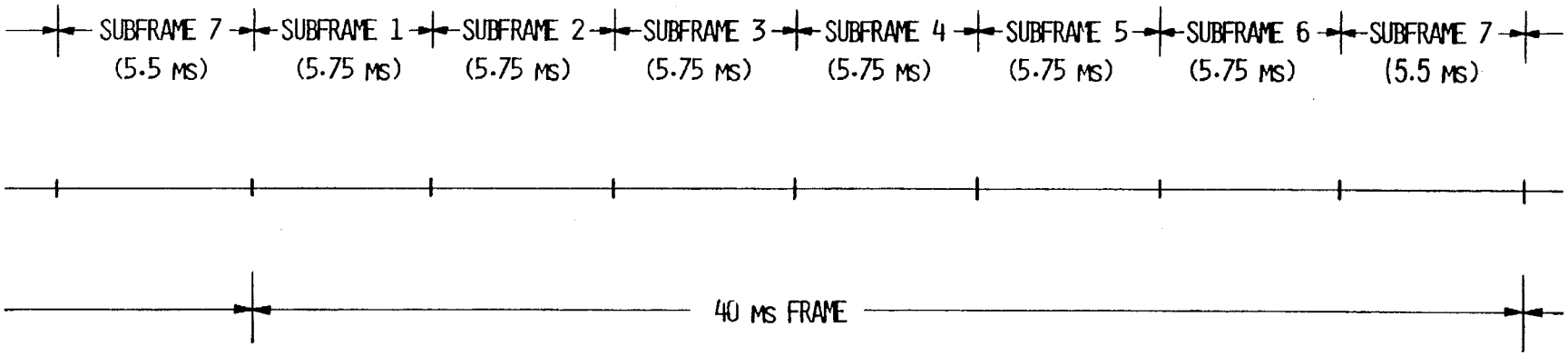
FIG. 12 is a timing diagram showing the subframe structure in mode A.

For mode A, the second pitch estimate is quantized and transmitted because it is used to guide the closed Iccp pitch estimation in each subframe. The quantization of the pitch estimate is accomplished using a uniform 4-bit quantizer. The 40 ms. speech frame is divided into seven subframes, as shown in FIG. 12. The first six are of length 5.75 ms. and the seventh is of length 5.5 ms. In each subframe, the excitation model parameters are derived in a dosed Iccp fashion using an analysis by synthesis technique. These excitation model parameters employed in block 35 in FIG. 3 are the adaptive codebook index, the adaptive codebook gain, the fixed codebook index, the fixed codebook gain, and the fixed codebook gain sign, as shown in more detail in FIG. 13. The filter coefficients are interpolated in the autocorrelation domain by interpolator 3501, and the interpolated output is supplied to four fixed codebooks 3502, 3503, 3504, and 3505. The other inputs to fixed codebooks 3502 and 3503 are supplied by adaptive codebook 3506, while the other inputs to fixed codebooks 3504 and 3505 are supplied by adaptive codebook 3507. Each of the adaptive codebooks 3506 and 3507 receive input speech for the subframe and, respectively, parameters for the best and second best paths from previous subframes. The outputs of the fixed codebooks 3502 to 3505 are input to respective speech synthesis circuits 3508 to 3511 which also receive the interpolated output from interpolator 3501. The outputs of circuits 3508 to 3511 are supplied to selector 3512 which, using a measure of the signal-to-noise ratios (SNRs), prunes and selects the best two paths based on the input speech.

As shown in FIG. 13, the analysis by synthesis technique that is used to derive the excitation model parameters employs an interpolated set of short term predictor coefficients in each subframe. The determination of the optimal set of excitation model parameters for each subframe is determined only at the end of each 40 ms. frame because of delayed decision. In deriving the excitation model parameters, all the seven subframes are assumed to be of length 5.75 ms. or forty-six samples. However, for the last or seventh subframe, the end of subframe updates such as the adaptive codebook update and the update of the local short term predictor state variables are carried out only for a subframe length of 5.5 ms. or forty-four samples.

The short term predictor parameters or linear prediction filter parameters are interpolated from subframe to subframe. The interpolation is carried out in the autocorrelation domain. The normalized autocorrelation coefficients derived from the quantized filter coefficients for the second linear prediction analysis window are denoted as $\{p_{-1}(i)\}$ for the previous 40 ms. frame and by $\{p\mathbf{2}(i)\}$ for the current 40 ms. frame for $0 \leqq i$ 23 10 with $p_{-1}(\mathbf{0})=p_2(\mathbf{0})=1.0$. Then the interpolated autocorrelation coefficients $\{p'_m(i)\}$ are then given by $$p'_m(i)=\nu_m \cdot p_2(i)+[1-\nu_m]\cdot p_{-1}(i), 1 \leqq m \leqq 7, 0 \leqq i \leqq 10,$$

or in vector notation $$p'_m=\nu_m \cdot p_2+[1-\nu_m]\cdot p_{-1}, 1 \leqq m \leqq 7.$$

Here, $\nu_m$ is the interpolating weight for subframe m. The interpolated lags $\{p'_m(i)\}$ are subsequently converted to the short term predictor filter coefficients $\{a'_m(i)\}$.

The choice of interpolating weights affects voice quality in this mode significantly. For this reason, they must be determined carefully. These interpolating weights $\nu_m$ have been determined for subframe m by minimizing the mean square error between actual short term spectral envelope $S_{m,J}(\omega)$ and the interpolated short term power spectral envelope $S'_{m,J}(\omega)$ over all speech frames J of a very large speech database. In other words, m is determined by minimizing $$E_m=\sum_J \frac{1}{2\pi}\int_{-\pi}^{\pi} |S_{m,J}(\omega)-S'_{m,J}(\omega)|^2 d\omega.$$

If the actual autocorrelation coefficients for subframe m in frame J are denoted by $\{p_{m,J}(k)\}$, then by definition $$S_{m,J}(w)=\sum_{-10}^{10} P_{m,j}(k)\, e^{-jwk}$$

$$S'_{m,j}(\omega)=\sum_{-10}^{10} \rho'_{m,j}(k)\, e^{-jwk}.$$

Substituting the above equations into the preceding equation, it can be shown that minimizing $E_m$ is equivalent to minimizing $E'_m$ where $E'_m$ is given by $$E'_m=\sum_J \sum_{k=-10}^{10} [\rho_{m,j}(k)-\rho'_{m,j}(k)]^2,$$

or in vector notation $$E'_m=\sum_J \|\rho_{m,J}-\rho'_{m,J}\|^2,$$

where $\|\cdot\|$ represents the vector norm. Substituting $p'_m$ into the above equation, differentiating with respect to $\nu_m$ and setting it to zero results in $$\nu_m=\frac{\left[\sum_J \langle x_J, y_{m,J}\rangle\right]}{\sum_J \|x_J\|^2},$$

where $x_{J=p2,J}-p_{-1,J}$ and $y_{m,J}=p_{m,J}-p_{-1,J}$ and $\langle x_J, y_{m,J}\rangle$ is the dot product between vectors $x_J$ and $y_{m,J}$. The values of $\nu_m$ calculated by the above method using a very large speech database are further fine tuned by careful listening tests.

The target vector $t_{ac}$ for the adaptive codebook search is related to the speech vector s in each subframe by $s=Ht_{ac}+z$. Here, H is the square lower triangular toeplitz matrix whose first column contains the impulse response of the interpolated short term predictor $\{a'_m(i)\}$ for the subframe m and z is the vector containing its zero input response. The target vector $t_{ac}$ is most easily calculated by subtracting the zero input response z from the speech vector s and filtering the difference by the inverse short term predictor with zero initial states.

The adaptive codebook search in adaptive codebooks 3506 and 3507 employs a spectrally weighted mean square error $\epsilon_i$ to measure the distance between a candidate vector $r_i$ and the target vector $t_{ac}$, as given by $$\epsilon_i=(t_{ac}-\mu_i r_i)^T W (t_{ac}-\mu_i r_i).$$

Here, $\mu_i$ the associated gain and W is the spectral weighting matrix. W is a positive definite symmetric toeplitz matrix that is derived from the truncated impulse response of the weighted short term predictor with filter coefficients $\{a'_m(i)\cdot^i\}$. The weighting factor $\gamma$ is 0.8. Substituting for the optimum $\mu_i$ in the above expression, the distortion term can be rewritten as $$\epsilon_i=t_{ac}^T W t_{ac}-\frac{[\rho_i]^2}{e_i},$$

where $p_i$ is the correlation term $t_{ac}{}^T W r_i$ and $e_i$ is the energy term $r_i{}^T W r_i$. Only those candidates are considered that have a positive correlation. The best candidate vectors are the ones that have positive correlations and the highest values of $$\frac{[\rho_i]^2}{e_1}.$$

The candidate vector $r_i$ corresponds to different pitch delays. The pitch delays in samples consists of four subranges. They are {20.0}, {20.5, 20.75, 21.0, 21.25, . . . , 50.25}, {50.50, 51.0, 51.5, 52.0, 52.5, . . . , 87.5}, and {88.0, 89.0, 90.0, 91.0, . . . , 146.0}. There are a total of 225 pitch delays and corresponding candidate vectors. The candidate vector corresponding to an integer delay L is simply read from the adaptive codebook, which is a collection of the past excitation samples. For a mixed (integer plus fraction) delay L+f, the portion of the adaptive codebook centered around the section corresponding to integer delay L is filtered by a polyphase filter corresponding to fraction f. Incomplete candidate vectors corresponding to low delays close to or less than a subframe are completed in the same manner as suggested by J. Campbell et al., supra. The polyphase filter coefficients are derived from a Hamming windowed sinc function. Each polyphase filter has sixteen taps.

The adaptive codebook search does not search all candidate vectors. A 6-bit search range is determined by the quantized open Iccp pitch estimate $P'_2$ of the current 40 ms. frame and that of the previous 40 ms. frame $P'_{-4}$ if it were a mode A frame. If the previous mode were mode B, then $P'_{-1}$ is taken to be the last subframe pitch delay in the previous frame. This 6-bit range is centered around $P'_{-1}$ for the first subframe and around $P'_2$ for the seventh subframe. For intermediate subframes two to six, the 6-bit search range consists of two 5-bit search ranges. One is centered around $P'_{-1}$ and the other is centered around $p'_2$. These two ranges overlap and are not exclusive, then a single 6- bit range centered around $(P'_{-1}+P'_2)/2$ is utilized. A candidate vector with pitch delay in this range is translated into a 6-bit index. The zero index is reserved for an all zero adaptive codebook vector. This index is chosen if all candidate vectors in the search range do not have positive correlations. This index is accommodated by trimming the 6-bit or sixty-four delay search range to a sixty-three delay search range. The adaptive codebook gain, which is constrained to be positive, is determined outside the search Iccp and is quantized using a 3-bit quantization table.

Since delayed decision is employed, the adaptive codebook search produces the two best pitch delay or lag candidates in all subframes. Furthermore, for subframes two to six, this has to be repeated for the two best target vectors produced by the two best sets of excitation model parameters derived for the previous subframes in the current frame. This results in two best lag candidates and the associated two adaptive codebook gains for subframe one and in four best lag candidates and the associated four adaptive codebook gains for subframes two to six at the end of the search process. In each case, the target vector for the fixed codebook is derived by subtracting the scaled adaptive codebook vector from the target for the adaptive codebook search, i.e., $t_{sc}=t_{ac}-\mu_{opt}r_{opt}$, where $r_{opt}$ is the selected adaptive codebook vector and $\mu_{opt}$ is the associated adaptive codebook gain.

In mode A, a 6-bit glottal pulse codebook is employed as the fixed codebook. The glottal pulse codebook vectors are generated as time-shifted sequences of a basic glottal pulse characterized by parameters such as position, skew and duration. The glottal pulse is first computed at 16 KHz sampling rate as $$g(n)=0,\ 0 \leqq n \leqq n_0,$$

$$g(n)=A\cdot\sin^2\left(\frac{\pi(n-n_0)T}{2T_p}\right),\ n_0<n\leqq n_0+n_1,$$

$$g(n)=A\cdot\cos\left(\frac{\pi((n-n_0)T-T_p)}{2T_n}\right),\ n_0+n_1<n\leqq n_0+n_2,$$

$$g(n)=0,\ n_0+n_2<n\leqq n_g.$$

Figure 14:
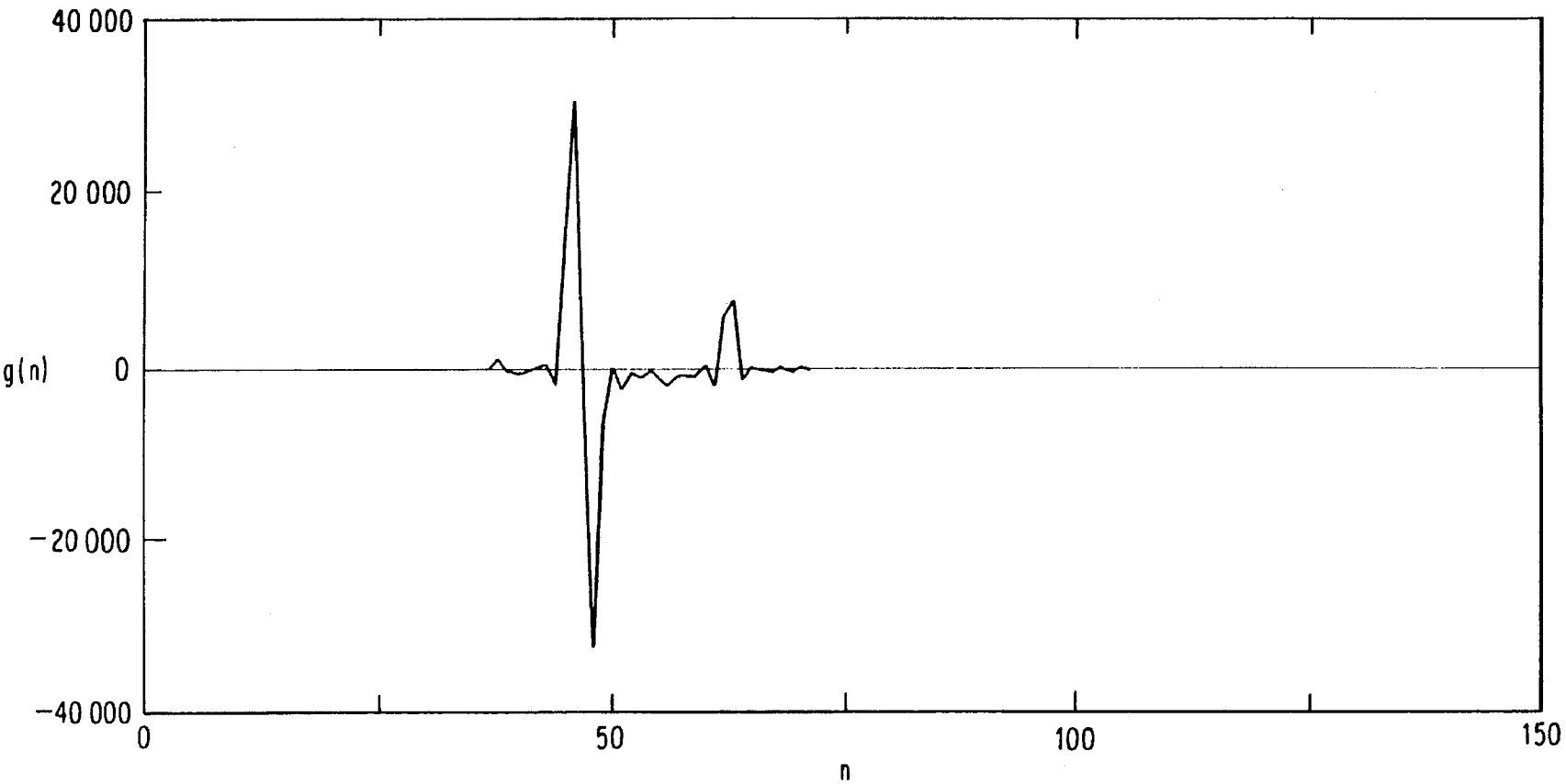
FIG. 14 is a graph showing the glottal pulse shape.

In the above equations, the values of the various parameters are assumed to be T=62.5 μs, $T_p$=440 μs, $T_n$=1760 μs, $n_0$=88, $n_1$=7, $n_2$=35, and $n_g$=232. The glottal pulse, defined above, is differentiated twice to flatten its spectral shape. It is then lowpass filtered by a thirty-two tap linear phase FIR filter, trimmed to a length of 216 samples, and finally decimated to the 8 KHz sampling rate to produce the glottal pulse codebook. The final length of the glottal pulse codebook is 108 samples. The parameter A is adjusted so that the glottal pulse codebook entries have a root mean square (RMS) value per entry of 0.5. The final glottal pulse shape is shown in FIG. 14. The codebook has a scarcity of 67.6% with the first thirty-six entries and the last thirty-seven entries being zero.

There are sixty-three glottal pulse codebook vectors each of length forty-six samples. Each vector is mapped to a 6-bit index. The zeroth index is reserved for an all zero fixed codebook vector. This index is assigned if the search results in a vector which increases the distortion instead of reducing it. The remaining sixty-three indices are assigned to each of the sixty-three glottal pulse codebook vectors. The first vector consists of the first forty-six entries in the codebook, the second vector consists of forty-six entries starting from the second entry, and so on. Thus, there is an overlapping, shift by one, 67.6% sparse fixed codebook. Furthermore, the nonzero elements are at the center of the codebook while the zeroes are its tails. These attributes of the fixed codebook are exploited in its search. The fixed codebook search employs the same distortion measure as in the adaptive codebook search to measure the distance between the target vector $t_{sc}$ and every candidate fixed codebook vector $c_i$, i.e., $\xi_i=(t_{sc}-\lambda_i c_i)^T W(t_{sc}-\lambda_i c_i)$, where W is the same spectral weighting matrix used in the adaptive codebook search. The gain magnitude $|\lambda|$ is quantized within the search Iccp for the fixed codebook. For odd subframes, the gain magnitude is quantized using a 4-bit quantization table. For even subframes, the quantization is done using a 3-bit quantization range centered around the previous subframe quantized magnitude. This differential gain magnitude quantization is not only efficient in terms of bits but also reduces complexity since this is done inside the search. The gain sign is also determined inside the search loop. At the end of the search procedure, the distortion with the selected codebook vector and its gain is compared to $t^T_{sc}Wt_{sc}$, the distortion for an all zero fixed codebook vector. If the distortion is higher, then a zero index is assigned to the fixed codebook index and the all zero vector is taken to be the selected fixed codebook vector.

Due to delayed decision, there are two target vectors $t_{sc}$ for the fixed codebook search in the first subframe corresponding to the two best lag candidates and their corresponding gains provided by the closed Iccp adaptive codebook search. For subframes two to seven, there are four target vectors corresponding to the two best sets of excitation model parameters determined for the previous subframes so far and to the two best lag candidates and their gains provided by the adaptive codebook search in the current subframe. The fixed codebook search is therefore carried out two times in subframe one and four times in subframes two to six. But the complexity does not increase in a proportionate manner because in each subframe, the energy terms $c^T_iWc_i$ are the same. It is only the correlation terms $t^T_{sc}Wc_i$ that are different in each of the two searches for subframe one and in each of the four searches two to seven.

Delayed decision search helps to smooth the pitch and gain contours in a CELP coder. Delayed decision is employed in this invention in such a way that the overall codec delay is not increased. Thus, in every subframe, the closed loop pitch search produces the M best estimates. For each of these M best estimates and N best previous subframe parameters, MN optimum pitch gain indices, fixed codebook indices, fixed codebook gain indices, and fixed codebook gain signs are derived. At the end of the subframe, these MN solutions are pruned to the L best using cumulative SNR for the current 40 ms. frame as the criteria. For the first subframe, M=2, N=1 and L=2 are used. For the last subframe, M=2, N=2 and L=1 are used. For all other subframes, M=2, N=2 and L=2 are used. The delayed decision approach is particularly effective in the transition of voiced to unvoiced and unvoiced to voiced regions. This delayed decision approach results in N times the complexity of the closed loop pitch search but much less than MN times the complexity of the fixed codebook search in each subframe. This is because only the correlation terms need to be calculated MN times for the fixed codebook in each subframe but the energy terms need to be calculated only once.

Figure 15:
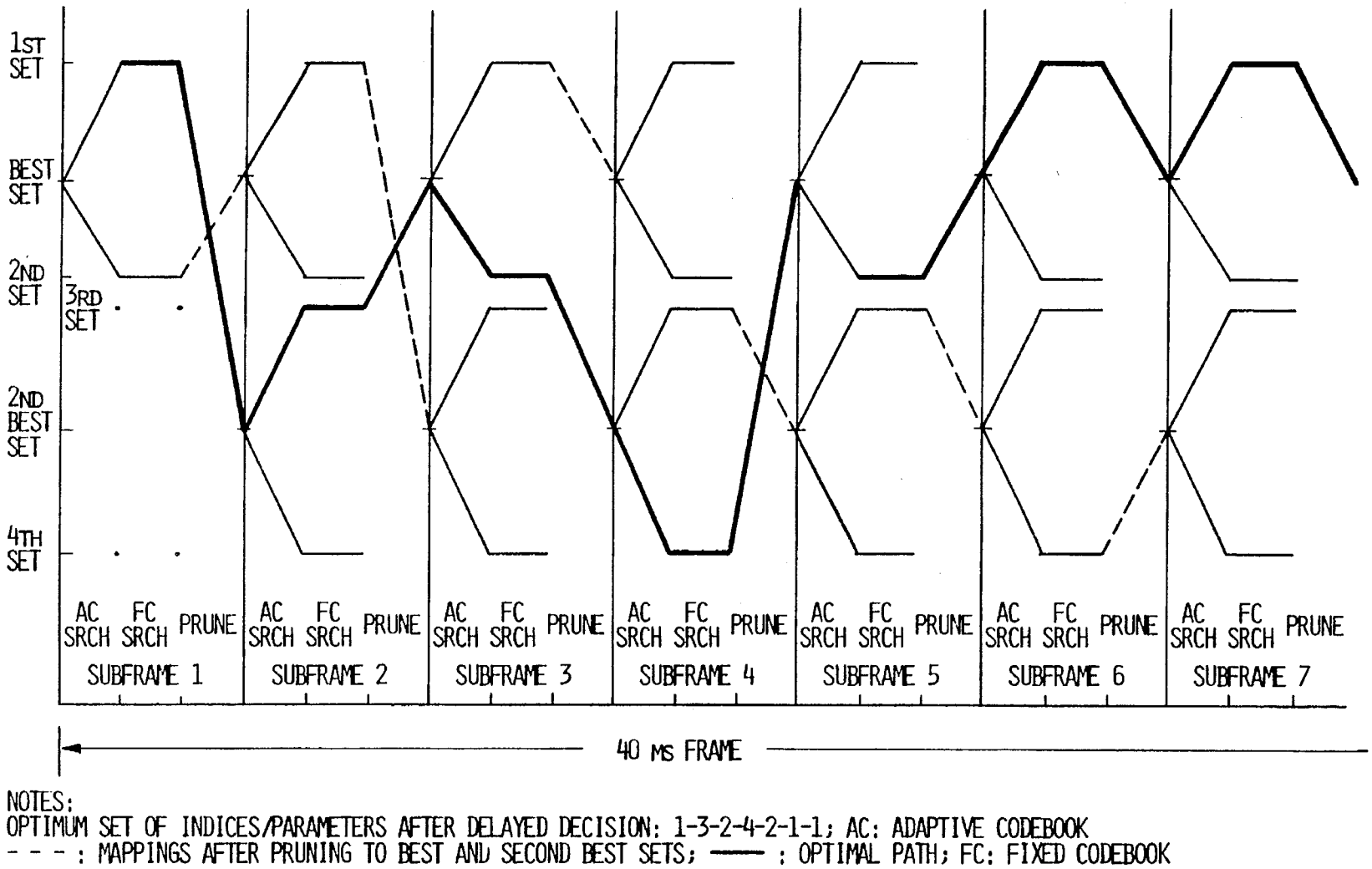
FIG. 15 is a timing diagram showing an example of traceback after delayed decision in mode A.

The optimal parameters for each subframe are determined only at the end of the 40 ms. frame using traceback. The pruning of MN solutions to L solutions is stored for each subframe to enable the trace back. An example of how traceback is accomplished is shown in FIG. 15. The dark, thick line indicates the optimal path obtained by traceback after the last subframe.

For mode B, both sets of line spectral frequency vector quantization indices need not be transmitted. But neither of the two open loop pitch estimates are transmitted since they are not used in guiding the closed loop pitch estimation in mode B. The higher complexity involved as well as the higher bit rate of the short term predictor parameters in mode B is compensated by a slower update of the excitation model parameters.

For mode B, the 40 ms. speech frame is divided into five subframes. Each subframe is of length 8 ms. or sixty-four samples. The excitation model parameters in each subframe are the adaptive codebook index, the adaptive codebook gain, the fixed codebook index, and the fixed codebook gain. There is no fixed codebook gain sign since it is always positive. Best estimates of these parameters are determined using an analysis by synthesis method in each subframe. The overall best estimate is determined at the end of the 40 ms. frame using a delayed decision approach similar to mode A.

The short term predictor parameters or linear prediction filter parameters are interpolated from subframe to subframe in the autocorrelation lag domain. The normalized autocorrelation lags derived from the quantized filter coefficients for the second linear prediction analysis window are denoted as $\{p'_1(i)\}$ for the previous 40 ms. frame. The corresponding lags for the first and second linear prediction analysis windows for the current 40 ms. frame are denoted by $\{p_1(i)\}$ and $\{p_2(i)\}$, respectively. The normalization ensures that $p_1(0)=p_1(0)=p_2(O)=1.0$. The interpolated autocorrelation lags $\{p'_m(i)\}$ are given by $$p'_m(i)=\alpha_m \cdot p_1+\beta_m \cdot p_1(i)+[1-\alpha_m-\beta]\cdot p_2 1<=<=5, 0<=/<=10,$$

or in vector notation $$p'_m=\alpha_m \cdot p_1 \beta_m \cdot p_1[1-a_m \beta]\cdot p_1 1<=m<=5.$$

Here, $\alpha_m$ and $\beta_m$ are the interpolating weights for subframe m. The interpolation lags $\{p'_m(i)\}$ are subsequently converted to the short term predictor filter coefficients $\{\alpha'_m(i)\}$.

The choice of interpolating weights is not as critical in this mode as it is in mode A. Nevertheless, they have been determined using the same objective criteria as in mode A and fine tuning them by careful but informal listening tests. The values of $\alpha_m$ and $\beta_m$ which minimize the objective criteria Em can be shown to be $$\alpha_m=\frac{Y_m C-X_m B}{C^2-AB}$$

-continued $$\beta_m=\frac{X_m C-Y_m A}{C^2-AB}$$

where $$A=\sum_J \|\rho_{-1,J}\rho_{2,J}\|^2$$

$$B=\sum_J \|\rho_{-1,J}\rho_{2,J}\|^2$$

$$C=\sum_J <\rho_{-1,J}\cdot -\rho_{2,J}\cdot \rho_{1,J}-\rho_{2,J}>$$

$$X_m=\sum_J <\rho_{-1,J}-\rho_{2,J}\cdot \rho_{m,J}-\rho_{2,J}>$$

$$Y_m=\sum_J <\rho_{m,J}-\rho_{2,J}\cdot \rho_{1,J}\rho_{1,J}-\rho_{2,J}>$$

As before, $p_{-1,J}$ denotes the autocorrelation lag vector derived from the quantized filter coefficients of the second linear prediction analysis window of frame J-1, $p_{1,J}$ denotes the autocorrelation lag vector derived from the quantized filter coefficients of the first linear prediction analysis window of frame J, $p_{2,J}$ denotes the autocorrelation lag vector derived from the quantized filter coefficients of the second linear prediction analysis window of frame J, and $p_{mJ}$ denotes the actual autocorrelation lag vector derived from the speech samples in subframe m of frame J.

The fixed codebook is a 9-bit multi-innovation codebook consisting of two sections. One is a Hadamard vector sum section and other is a single pulse section. This codebook employs a search procedure that exploits the structure of these sections and guarantees a positive gain. This special codebook and the associated search procedure is by D. Lin in "Ultra-fast Celp Coding Using Deterministic Multicodebook Innovations," ICASSP 1992, 1317–320.

One component of the multi-innovation codebook is the deterministic vector-sum code constructed from the Hadamard matrix $H_m$. The code vector of the vector-sum code as used in this invention is expressed as $$u_1=\sum_{m-1}^{4} \theta_m v_m(n),\ 0 \leqq i \leqq 15,$$

where the basis vectors $v_m(n)$ re obtained from the rows of the Hadamard-Sylvester matrix and $\theta_m=\pm 1$. The basis vectors are selected based on a sequency partition of the Hadamard matrix. The code vectors of the Hadamard vector-sum codebooks are values and binary valued code sequences. Compared to previously considered algebraic codes, the Hadamard vector-sum codes are constructed to possess more ideal frequency and phase characteristics. This is due to the basis vector partition scheme used in this invention for the Hadamard matrix which can be interpreted as uniform sampling of the sequency ordered Hadamard matrix row vectors. In contrast, non-uniform sampling methods have produced inferior results.

The second component of the multi-innovation codebook is the single pulse code sequences consisting of the time shifted delta impulse as well as the more general excitation pulse shapes constructed from the discrete sinc and cosc functions. The generalized pulse shapes are defined as $$z_1(n)=Asinc(n)+Bcosc(n+1),$$

and $$z_1(n)=Asinc(n)+Bcosc(n+1),$$

where $$\text{sinc}(n) = \frac{\sin(\pi n)}{\pi n}, \; n \neq 0, \; \text{sinc}(0) = 1$$

and $$\text{cosc}(n) = \frac{1 - \cos(\pi n)}{\pi n}, \; n \neq 0, \; \text{cosc}(0) = 0$$

when the sine and cosc functions are time aligned, they correspond to what is known as the zinc basis function $z_0.(n)$. Informal listening tests show that time-shifted pulse shapes improve voice quality of the synthesized speech.

The fixed codebook gain is quantized using four bits in all subframes outside of the search loop. As pointed out earlier, the gain is guaranteed to be positive and therefore no sign bit needs to be transmitted with each fixed codebook gain index. Due to delayed decision, there are two sets of optimum fixed codebook indices and gains in subframe one and four sets in subframes two to five.

The delayed decision approach in mode B is identical to that used in mode A. The optimal parameters for each subframe are determined at the end of the 40 ms. frame using an identical traceback procedure.

Figure 16:
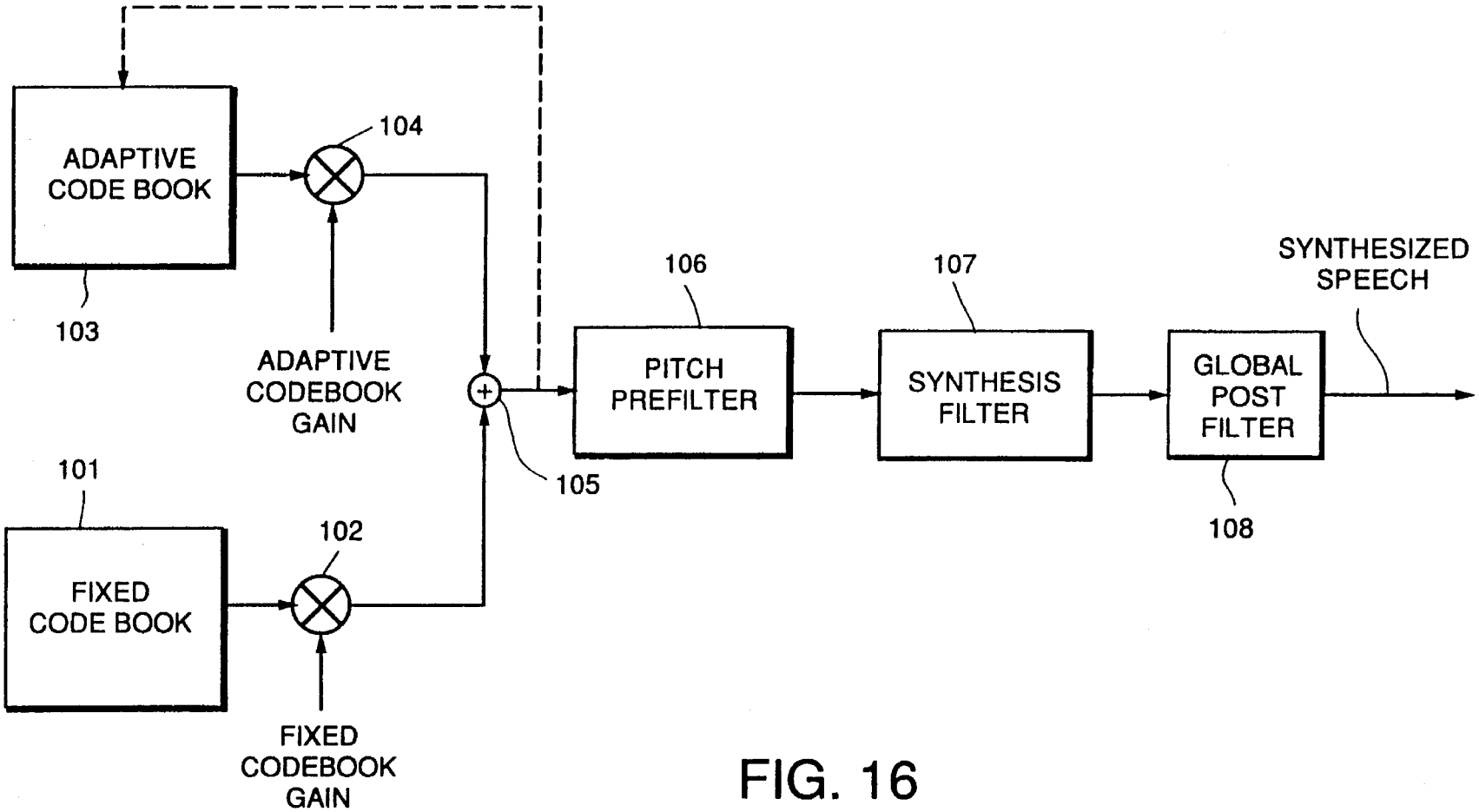
FIG. 16 is a block diagram showing an implementation of the speech decoder according to the invention.

The speech decoder 46 (FIG. 4) is shown in FIG. 16 and receives the compressed speech bitstream in the same form as put out by the speech encoder or FIG. 18. The parameters are unpacked after determining whether the received mode bit (MSB of the first compressed word) is 0 (mode A) or 1 (mode B). These parameters are then used to synthesize the speech. In addition, the speech decoder receives a cyclic redundancy check (CRC) based bad frame indicator from the channel decoder 45 (FIG. 1). This bad frame indictor flag is used to trigger the bad frame error masking and error recovery sections (not shown) of the decoder. These can also be triggered by some built-in error detection schemes.

In FIG. 9, for mode A, the second set of line spectral frequency vector quantization indices are used to address the fixed codebook 101 in order to reconstruct the quantized filter coefficients. The fixed codebook gain bits input to scaling multiplier 102 convert the quantized filter coefficients to autocorrelation lags for interpolation purposes. In each subframe, the autocorrelation lags are interpolated and converted to short term predictor coefficients. Based on the open loop quantized pitch estimate from multiplier 102 and the closed loop pitch index from multiplier 104, the absolute pitch delay value is determined in each subframe. The corresponding vector from adaptive codebook 103 is scaled by its gain in scaling multiplier 104 and summed by summer 105 with the scaled fixed codebook vector to produce the excitation vector in every subframe. This excitation signal is used in the closed loop control, indicated by dotted line 106, to address the adaptive codebook 103. The excitation signal is also pitch prefiltered in filter 107 as described by I. A. Gerson and M. A. Jasuik, supra, prior to speech synthesis using the short term predictor with interpolated filter coefficients. The output of the pitch filter 107 is further filtered in synthesis filter 108, and the resulting synthesized speech is enhanced using a global pole-zero postfilter 109 which is followed by a spectral tilt correcting single pole filter (not shown). Energy normalization of the postfiltered speech is the final step.

For mode B, both sets of line spectral frequency vector quantization indices are used to reconstruct both the first and second sets of autocorrelation lags. In each subframe, the autocorrelation lags are interpolated and converted to short term predictor coefficients. The excitation vector in each subframe is reconstructed simply as the scaled adaptive codebook vector from codebook 103 plus the scaled fixed codebook vector from codebook 101. The excitation signal is pitch prefiltered in filter 107 as in mode A prior to speech synthesis using the short term predictor with interpolated filter coefficients. The synthesized speech is also enhanced using the same global postfilter 109 followed by energy normalization of the postfiltered speech.

Limited built-in error detection capability is built into the decoder. In addition, external error detection is made available from the channel decoder 45 (FIG. 4) in the form of a bad frame indicator flag. Different error recovery schemes are used for different parameters in the event of error detection. The mode bit is clearly the most sensitive bit and for this reason it is included in the most perceptually significant bits that receive CRC protection and provided half rate protection and also positions next to the tail bits of the convolutional coder for maximum immunity. Furthermore, the parameters are packed into the compressed bitstream in a manner such that if there were an error in the mode bit, then the second set of LSF VQ indices and some of the codebook gain indices could still be salvaged. If the mode bit were in error, the bad frame indicator flag would be set resulting in the triggering of all the error recovery mechanisms which results in gradual muting. Built-in error detection schemes for the short term predictor parameters exploit the fact that in the absence of errors, the received LSFs are ordered. Error recovery schemes use interpolation in the event of an error in the first set of received LSFs and repetition in the event of errors in the second set of both sets of LSFs. Within each subframe, the error mitigation scheme in the event of an error in the pitch delay or the codebook gains involves repetition of the previous subframe values followed by attenuation of the gains. Built-in error detection capability exists only for the fixed codebook gain and it exploits the fact that its magnitude seldom swings from one extreme value to another from subframe to subframe. Finally, energy based error detection just after the postfilter is used as a check to ensure that the energy of the postfiltered speech in each subframe never exceeds a fixed threshold.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A low bit rate codec for coding and decoding a speech signal comprising:

means for receiving the speech signal and dividing the speech signal into speech frames;

linear predictive code analysis means operative on a speech frame for performing linear predictive code analysis on a first and a second linear prediction window the first linear prediction window being centered at the middle of the speech frame and the second linear prediction window being centered at the edge of the speech frame, wherein the linear predictive code analysis means generates a first set of filter coefficients for the first linear prediction window and a second set of filter coefficients for the second linear prediction window;

pitch estimation means for generating a pitch estimate for each of a first and a second pitch estimation window, the first pitch estimation window being centered at the middle of the speech frame and the second pitch estimation window being centered at the edge of the speech frame;

mode classification means responsive to the first and the second sets of filter coefficients and the first and the second pitch estimates, for classifying the speech frame into one of a plurality of modes, wherein a first mode is predominantly voiced and a second mode is not predominantly voiced;

encoding means for encoding the speech frame based on the classified mode of the speech frame, wherein, for a speech frame classified in the first mode, the encoded speech frame encodes information derived from the second set of linear coefficients and the second pitch estimate, and for a speech frame classified in the second mode, the encoded speech frame encodes information derived from the first and the second sets of linear coefficients;

transmitting means for transmitting the encoded speech frame;

receiving means for receiving a transmission for an encoded speech frame and identifying the transmitted speech frame as one of a first mode and a second mode speech frame; and decoder means for decoding the transmitted speech frame in a mode-specific manner based on the identified mode of the transmitted speech frame.

2. The low bit rate codec recited in claim 1 wherein said pitch estimation means comprises:

error computing means receiving data for computing an error function for each of the first and the second pitch estimation windows;

refining means responsive to the computed error functions for refining past pitch estimates;

pitch tracking means responsive to said refined past pitch estimates for producing a set of pitch candidates for each of the first and the second pitch estimation windows;

a pitch selector for selecting and outputting a pitch estimate from the set of pitch candidates for each of the first and the second pitch estimation windows.

3. The low bit rate codec recited in claim 2 wherein said mode classification means comprises:

an interpolater for generating an interpolated set of filter coefficients for the first linear prediction window based on the second set of filter coefficients;

a cepstral distortion tester for comparing a cepstral distortion measure between the first set of filter coefficients and the interpolated set of filter coefficients against a threshold value;

a first pitch deviation tester for comparing a refined pitch estimate for the second pitch estimation window and the first pitch estimate;

a second pitch deviation tester for comparing the second pitch estimate and the first pitch estimate; and mode selection means for selecting one of the first mode and the second mode for classifying the speech frame based on the comparisons by the cepstral distortion tester and the first and second pitch deviation testers.

4. A method of encoding and decoding a speech signal comprising the steps of:

receiving a speech signal and dividing the speech signal into speech frames;

performing linear predictive code analysis on a speech frame in each of a first and a second linear prediction window, the first linear prediction window being centered at the middle of the speech frame and the second linear prediction window being centered at the edge of the speech frame;

generating a first set of filter coefficients for the first linear prediction window and a second set of filter coefficients for the second linear prediction window;

generating a first pitch estimate for a first pitch estimation window and a second pitch estimate for a second pitch estimation window, the first pitch estimation window being centered at the middle of the speech frame and the second pitch estimation window being centered at the edge of the speech frame;

classifying the speech frame into one of a plurality of modes based on the first and the second sets of filter coefficients and the first and the second pitch estimates, wherein a first mode is predominantly voiced and a second mode is not predominantly voiced;

encoding the speech frame based on the classified mode of the speech frame, wherein, for a speech frame classified in the first mode, the encoded speech frame encodes information derived from the second set of linear coefficients and the second pitch estimate, and for a speech frame classified in the second mode, the encoded speech frame encodes information derived from the first and the second sets of linear coefficients; transmitting the encoded speech frame;

receiving a transmission for an encoded speech frame and identifying the transmitted speech frame as one of a first mode and a second mode speech frame; and decoding the transmitted speech frame in a mode-specific manner, based on the identified mode of the transmitted speech frame.

5. The method of claim 4, further including the steps of:

synthesizing a speech signal from the decoded speech frame; and post filtering the synthesized speech signal.

6. A coder for encoding a speech signal comprising:

a receiver for receiving the speech signal and dividing the speech signal into speech frames;

a linear predictor for performing linear predictive code analysis on a first and a second linear prediction window, the first linear prediction window being centered at the middle of the speech frame and the second linear prediction window being centered at the edge of the speech frame, wherein the linear predictor generates a first set of filter coefficients for the first linear prediction window and a second set of filter coefficients for the second linear prediction window;

a pitch estimator for generating a pitch estimate for each of a first and a second pitch estimation window, the first pitch estimation window being centered at the middle of the speech frame and the second pitch estimation window being centered at the edge of the speech frame;

a mode classifier responsive to the first and the second sets of filter coefficients and the first and the second pitch estimates, for classifying the speech frame into one of a plurality of modes, wherein a first mode is predominantly voiced and a second mode is not predominantly voiced; and an encoder for encoding the speech frame based on the classified mode of the speech frame.

7. The coder recited in claim 6 wherein the pitch estimator comprises:

an error calculator for receiving data for calculating an error function for the first and the second pitch estimation windows;

a refiner responsive to the calculated error functions for refining past pitch estimates;

a pitch tracker responsive to the refined past pitch estimates for producing a set of pitch candidates for each of the first and the second pitch estimation windows;

a pitch selector for selecting and outputting a pitch estimate from the set of pitch candidates for each of the first and the second pitch estimation windows.

8. The coder recited in claim 6 wherein the mode classifier comprises:

an interpolater for generating an interpolated set of filter coefficients for the first linear prediction window based on the second set of filter coefficients;

a cepstral distortion tester for comparing a cepstral distortion measure between the first set of filter coefficients and the interpolated set of filter coefficients against a threshold value;

a first pitch deviation tester for comparing a refined pitch estimate for the second pitch estimation window and the first pitch estimate;

a second pitch deviation tester for comparing the second pitch estimate and the first pitch estimate; and a mode selector for selecting one of the first mode and the second mode for classifying the speech frame, based on the comparisons by the cepstral distortion tester and the first and second pitch deviation testers.

9. The coder recited in claim 6, wherein each speech frame is partitioned into subframes, and the coder further comprises a closed loop pitch estimator for estimating a pitch for each subframe of a speech frame classified in the first mode based on the second pitch estimate for the speech frame.

10. The coder recited in claim 6, wherein the speech frame is partitioned into subframes, and the coder further comprises a delayed decision excitation modeler for modeling the excitation of each subframe with a set of excitation parameters by:

estimating M pitch estimates for each subframe;

determining a set of MN excitation parameter candidates for each excitation parameter for each of the M pitch estimates based on N previously coded speech subframes; and selecting L excitation parameter estimates from each set of MN excitation parameter candidates;

wherein M, N and L are positive integers variable with each subframe.

11. The coder recited in claim 10, further comprising a glottal pulse fixed codebook and a multi-innovation fixed codebook, wherein for a speech frame classified in the first mode, one of the set of excitation parameters is an index into the glottal pulse fixed codebook, and for a speech frame classified in the second mode, one of the set of excitation parameters is an index into the multi-innovation fixed codebook.

12. A method of encoding a speech signal comprising the steps of:

receiving a speech signal and dividing the speech signal into speech frames;

performing linear predictive code analysis on a speech frame in a first and a second linear prediction window, the first linear prediction window being centered at the middle of the speech frame and the second linear prediction window being centered at the edge of the speech frame;

generating a first set of filter coefficients for the first linear prediction window and a second set of filter coefficients for the second linear prediction window;

generating a first pitch estimate for a first pitch estimation window and a second pitch estimate for a second pitch estimation window, the first pitch estimation window being centered at the middle of the speech frame and the second pitch estimation window being centered at the edge of the speech frame;

classifying the speech frame into one of a plurality of modes based on the first and the second sets of filter coefficients and the first and the second pitch estimates, wherein a first mode is predominantly voiced and a second mode is predominantly not voiced;

encoding the speech frame based on the classified mode of the speech frame; and transmitting the encoded speech frame.

13. The encoding method recited in claim 12 wherein the pitch estimate generation step further comprises:

receiving data for calculating an error function for the first and the second pitch estimation windows;

refining past pitch estimates responsive to the calculated error functions;

producing a set of pitch candidates for each of the first and the second pitch estimation windows responsive to the refined past pitch estimates;

selecting and outputting a pitch estimate from the set of pitch candidates for each of the first and the second pitch estimation windows.

14. The encoding method recited in claim 12 wherein the mode classification step further comprises:

generating an interpolated set of filter coefficients for the first linear prediction window based on the second set of filter coefficients;

comparing a cepstral distortion measure between the first set of filter coefficients and the interpolated set of filter coefficients against a threshold value;

comparing a first pitch deviation between the refined pitch estimate for the second pitch estimation window and the first pitch estimate;

comparing a second pitch deviation between the second pitch estimate and the first pitch estimate; and selecting one of the first mode and the second mode for classifying the speech frame, based on the comparisons of the cepstral distortion tester, and the first and second pitch deviations.

15. The encoding method recited in claim 12, further comprising the steps of:

partitioning each speech frame into subframes; and estimating a pitch through a closed loop pitch estimation for each subframe of a speech frame classified in the first mode based on the second pitch estimate for the speech frame.

16. The encoding method recited in claim 12, further comprising the steps of:

partitioning the speech frame into subframes; and modeling the excitation of each subframe with a set of excitation parameters by:

estimating M pitch estimates for each subframe;

determining a set of MN excitation parameter candidates for each excitation parameter for each of the M pitch estimates based on N previously coded speech subframes; and selecting L excitation parameter estimates from each set of MN excitation parameter candidates;

wherein M, N and L are positive integers variable with each subframe.

17. The encoding method recited in claim 16, further comprising the step of providing a glottal pulse fixed codebook and a multi-innovation fixed codebook, wherein for a speech frame classified in the first mode, one of the set of excitation parameters is an index into the glottal pulse fixed codebook, and for a speech frame classified in the second mode, one of the set of excitation parameters is an index into the multi-innovation fixed codebook.

* * * * *